US008093963B2

(12) United States Patent
Yamashita et al.

(10) Patent No.: US 8,093,963 B2
(45) Date of Patent: Jan. 10, 2012

(54) LAMINATED BANDPASS FILTER, HIGH-FREQUENCY COMPONENT AND COMMUNICATIONS APPARATUS COMPRISING THEM

(75) Inventors: Takahiro Yamashita, Kumagaya (JP); Kazuhiro Hagiwara, Kumagaya (JP); Keisuke Fukamachi, Kumagaya (JP); Shigeru Kemmochi, Kumagaya (JP)

(73) Assignee: Hitachi Metals, Ltd., Tokyo (JP)

( * ) Notice: Subject to any disclaimer, the term of this patent is extended or adjusted under 35 U.S.C. 154(b) by 208 days.

(21) Appl. No.: 12/516,434

(22) PCT Filed: Dec. 3, 2007

(86) PCT No.: PCT/JP2007/073349

§ 371 (c)(1), (2), (4) Date: May 27, 2009

(87) PCT Pub. No.: WO2008/066198

PCT Pub. Date: Jun. 5, 2008

(65) Prior Publication Data

US 2010/0073108 A1 Mar. 25, 2010

(30) Foreign Application Priority Data

Dec. 1, 2006 (JP) ..... 2006-325808
Jun. 26, 2007 (JP) ..... 2007-168136
Jun. 28, 2007 (JP) ..... 2007-170097

(51) Int. Cl.
*H01P 1/203* (2006.01)

(52) U.S. Cl. ..... 333/204; 333/134

(58) Field of Classification Search ..... 333/185, 333/204, 219, 134, 205
See application file for complete search history.

(56) References Cited

U.S. PATENT DOCUMENTS

| | | | | | |
|---|---|---|---|---|---|
| 5,489,881 | A | * | 2/1996 | Yuda et al. | 333/203 |
| 5,497,130 | A | * | 3/1996 | Hirai et al. | 333/204 |
| 5,576,672 | A | * | 11/1996 | Hirai et al. | 333/204 |
| 5,621,366 | A | * | 4/1997 | Gu et al. | 333/204 |
| 6,265,954 | B1 | * | 7/2001 | Krause | 333/204 |
| 7,023,301 | B2 | * | 4/2006 | Kawahara et al. | 333/204 |
| 7,432,786 | B2 | * | 10/2008 | Tomaki et al. | 333/204 |
| 7,663,455 | B2 | * | 2/2010 | Goi et al. | 333/204 |
| 7,902,944 | B2 | * | 3/2011 | Fukunaga | 333/203 |
| 2003/0085780 | A1 | * | 5/2003 | Wang | 333/204 |
| 2007/0001786 | A1 | | 1/2007 | Kundu | |
| 2008/0215279 | A1 | | 9/2008 | Salsbury et al. | |

FOREIGN PATENT DOCUMENTS

| | | | | |
|---|---|---|---|---|
| JP | 09-294001 | A | | 11/1997 |
| JP | 2002-016403 | A | | 1/2002 |
| JP | 2003-152403 | A | | 5/2003 |
| JP | 2004-032557 | A | | 1/2004 |
| JP | 2005159512 | A | * | 6/2005 |
| JP | 2006-033614 | A | | 2/2006 |
| JP | 2006-166136 | A | | 6/2006 |
| JP | 2006287985 | A | * | 10/2006 |
| JP | 2007-013962 | A | | 1/2007 |

* cited by examiner

*Primary Examiner* — Seungsook Ham
(74) *Attorney, Agent, or Firm* — Sughrue Mion, PLLC

(57) ABSTRACT

A three-stage-resonator, laminated bandpass filter comprising electromagnetically coupled first to third resonator electrodes, adjacent first and second resonator electrodes and a third resonator electrode being different in a grounding direction, and a coupling-capacitor electrode extending over resonator electrodes.

19 Claims, 18 Drawing Sheets

LAMINATED BANDPASS FILTER, HIGH-FREQUENCY COMPONENT AND COMMUNICATIONS APPARATUS COMPRISING THEM

CROSS REFERENCE TO RELATED APPLICATIONS

This application is a National Stage of International Application No. PCT/JP2007/073349 filed Dec. 3, 2007, claiming priority based on Japanese Patent Application Nos. 2006-325808, filed Dec. 1, 2006, 2007-168136, filed Jun. 26, 2007, and 2007-170097, filed Jun. 28, 2007, the contents of all of which are incorporated herein by reference in their entirety.

FIELD OF THE INVENTION

The present invention relates to a laminated bandpass filter used for wireless communications such as cell phones, wireless LAN, etc., a high-frequency component, and a communications apparatus comprising them.

BACKGROUND OF THE INVENTION

In communications apparatuses, bandpass filters act to pass only particular frequency bands with low loss, while blocking unnecessary high-frequency or low-frequency noises. As communications apparatuses used in portable wireless communications systems, etc. are miniaturized, laminated bandpass filters advantageous for miniaturization have become widely used (for instance, JP 2006-166136 A).

FIG. 23 shows the equivalent circuit of a bandpass filter described in JP 2006-166136 A, and FIG. 24 shows electrode patterns on layers in a laminated bandpass filter having the above equivalent circuit. This laminated bandpass filter comprises three one-side-short-circuited strip resonator electrodes 23*a*, 23*b*, 23*c* with alternating short-circuited sides formed in parallel on a sheet 4, three wavelength-shortening electrodes 22*a*, 22*b*, 22*c*, whose short-circuited sides are opposite to those of the strip resonator electrodes, formed on an upper sheet 3 at positions corresponding to the strip resonator electrodes 23*a*, 23*b*, 23*c*, and a capacitor electrode 28 formed on a lower sheet 5. The resonator electrodes 23*a*, 23*c* on the input and output sides are capacitance-coupled by the capacitor electrode 28.

As shown in FIG. 23, the center strip resonator electrode 23*b* is grounded on the upper side oppositely to the strip resonator electrodes 23*a*, 23*c* on both sides. With this difference, as shown in FIG. 24, the resonator electrodes 23*a*, 23*c* on both sides are connected to a ground electrode 29 on one side, while the center resonator electrode 23*b* is grounded on an opposite side. The laminated bandpass filter having the above structure, which is described in JP 2006-166136 A, is miniaturized with improved attenuation characteristics. However, because only signals in a necessary frequency band are permitted to pass in bandpass filters for wireless communications, there is increasingly higher demand for larger attenuation. Also, the miniaturization of wireless communications apparatuses has been increasing demand for further miniaturization of bandpass filters. However, the bandpass filter of JP 2006-166136 A does not have sufficient attenuation characteristics to meet the demand of miniaturization.

To adjust the filter characteristics of a bandpass filter while meeting the demand of miniaturization, JP 2002-16403 A discloses a dielectric filter having one resonator electrode having a different shape from those of the other resonator electrodes for controlling a resonance frequency without connection of a load capacitor. However, when the resonance frequency is adjusted only with the resonance electrode described in JP 2002-16403 A, change occurs not only in the resonance frequency but also in the degree of coupling between the resonators, resulting in the complicated adjustment of filter characteristics. When the shapes of the resonance electrodes are largely changed to adjust the resonance frequency, the area efficiency of the filter decreases, disadvantageous for miniaturization.

JP 2003-152403 A discloses a laminated bandpass filter comprising a first resonator comprising series-connected first transmission line and first grounded capacitor, a second resonator parallel-connected to the first resonator and comprising series-connected second transmission line and second grounded capacitor, a third resonator parallel-connected to the second resonator and comprising series-connected third transmission line and third grounded capacitor, and a coupling capacitor for coupling the first resonator and the third resonator, the main coupling of the bandpass filter being obtained by magnetic coupling between the first transmission line and the second transmission line and between the second transmission line and the third transmission line, whereby the coupling capacitor adjusts the frequency of an attenuation pole. JP 2003-152403 A specifically shows a circuit in which the grounded capacitor in the second resonator is disposed on the opposite side of the second grounded capacitor, and a circuit in which the grounded capacitor in the third resonator is disposed on the opposite side of the third grounded capacitor. This laminated bandpass filter achieves improvement in attenuation characteristics and miniaturization.

However, because both input and output terminals are DC short-circuited, the laminated bandpass filter of JP 2003-152403 A needs a DC-cutting capacitor. When used for portable communications apparatuses, etc., the DC-cutting capacitor should be mounted on a substrate, hindering miniaturization. When the DC-cutting capacitor is formed in the laminated bandpass filter, dielectric layers for forming this capacitor are needed, so that a laminated bandpass filter operated at 2.4 GHz, for instance; is 3.2 mm×2.5 mm×1.5 mm, larger than other circuit components mounted on a board, hindering miniaturization. In addition, when the reduction of area and height is sought only by the above structure, transmission lines become too close to the ground, resulting in reduced impedance of the transmission lines, and thus a poorer Q value with no load. Accordingly, steep filter characteristics shown in JP 2006-166136 A cannot be obtained.

JP 2003-152403 A describes that the position adjustment of the grounded capacitor connected to the resonator provides frequency compensation having an attenuation pole near the lower-frequency or higher-frequency side of a pass band. However, the generation of an attenuation pole on the low-frequency side fails to provide sufficient attenuation characteristics on the high-frequency side, and the generation of an attenuation pole on the high-frequency side fails to provide sufficient attenuation characteristics on the low-frequency side.

OBJECTS OF THE INVENTION

Accordingly, an object of the present invention is to provide a small laminated bandpass filter having excellent attenuation characteristics.

Another object of the present invention is to provide a high-performance, high-frequency component comprising such a laminated bandpass filter.

A further object of the present invention is to provide a high-performance communications apparatus comprising such a high-frequency component.

DISCLOSURE OF THE INVENTION

The laminated bandpass filter of the present invention comprises first to third resonator electrodes arranged such that adjacent electrodes are electromagnetically coupled, an input terminal connected to one of the resonator electrodes on both sides, and an output terminal connected to the other of the resonator electrodes on both sides, each of the adjacent first and second resonator electrodes having one-side end connected to a grounded capacitor and the other-side end directly grounded, the third resonator electrode having the one-side end directly grounded and the other-side end connected to a grounded capacitor, coupling capacitors being formed between the resonator electrodes, electrodes for both of the resonator electrodes and the coupling capacitors being formed in the laminate, and the coupling-capacitor electrodes overlapping two or more of the resonator electrodes via no ground electrode when viewed in a lamination direction. With this structure, miniaturization and improved attenuation characteristics can be achieved.

At least one of the plural coupling capacitors is preferably a jump capacitor formed between the resonator electrodes on both sides, the jump capacitor electrode comprising opposing electrodes each facing each of the resonator electrodes on both sides and a connecting electrode connecting the opposing electrodes, and the connecting electrode connecting the end portions of the opposing electrodes on one or the other side. With this structure, the resonator electrodes on both sides can be capacitively coupled, thereby obtaining steep attenuation characteristics on the higher- or lower-frequency side of a passband.

The rest of the coupling capacitors is preferably an interstage capacitor formed between the center resonator electrode and one resonator electrode adjacent thereto, an electrode for the interstage capacitor being directly connected to the input or output terminal. With this structure, one electrode can be used for an interstage capacitor and a capacitor directly connecting the input and output terminals, thereby miniaturizing the laminated bandpass filter.

It is preferable that both ends of the opposing electrodes are inside both longitudinal ends of each resonator electrode, and that the connection of the connecting electrode to the opposing electrodes is inside both ends of at least one of the opposing electrodes. With this structure, the influence of the jump capacitor on other devices than the electrodes in the laminated bandpass filter can be minimized. The connection of the connecting electrode to both opposing electrodes is more preferably inside both ends of the opposing electrodes.

It is preferable that the opposing electrodes have width equal to or more than that of the resonator electrodes on both sides, and that the connecting electrode has width smaller than that of the opposing electrodes. With this structure, a jump capacitor can be formed efficiently, while suppressing unnecessary capacitance from being generated between the connecting electrode and the center resonator electrode.

Each resonator electrode is preferably constituted by parallel-connecting ends of transmission lines formed on pluralities of layers. A gap between the transmission lines adjacent in a lamination direction is preferably smaller than a gap between the resonator electrodes adjacent in a planar direction. With this structure, the resonator electrodes have small resistance, providing a high-performance, laminated bandpass filter with reduced insertion loss.

A layer having the coupling-capacitor electrode is preferably arranged between a layer having an electrode connected to the input or output terminal and a layer having the resonator electrodes.

A layer having a first ground electrode, a layer having an electrode opposing the first ground electrode to constitute a capacitor, at least one layer provided with the resonator electrodes, a layer having an electrode opposing a second ground electrode to constitute a capacitor, and a layer provided with the second ground electrode are preferably laminated in this order. With this arrangement, the resonator electrodes are as distant from the ground electrode as possible, providing a high-performance, laminated bandpass filter.

A gap between the first and second resonator electrodes is preferably different from a gap between the second and third resonator electrodes. Particularly, the gap between the first and second resonator electrodes is larger than the gap between the second and third resonator electrodes.

In the laminated bandpass filter, at least part of an electrode constituting the grounded capacitor is preferably sandwiched by the ground electrodes.

The laminated bandpass filter according to one embodiment of the present invention comprises an input terminal, an output terminal, and first to eighth capacitors, the first, second and fifth capacitors being coupling capacitors;

the sixth, seventh and eighth capacitors being grounded capacitors;

the first resonator electrode having one-side end connected to the input terminal via the third capacitor and grounded via the sixth capacitor, and the other-side end directly grounded;

the second resonator electrode having one-side end grounded via the seventh capacitor and the other-side end directly grounded;

the third resonator electrode having one-side end directly grounded, and the other-side end connected to the output terminal via the fourth capacitor and grounded via the eighth capacitor;

one-side end of the first resonator electrode being connected to one-side end of the second resonator electrode via the first capacitor;

the other-side end of the second resonator electrode being connected to the other-side end of the third resonator electrode via the second capacitor; and one-side end of the first resonator electrode being connected to one-side end of the third resonator electrode via the fifth capacitor.

The laminated bandpass filter according to another embodiment of the present invention comprises an input terminal, an output terminal, and first to eighth capacitors, the first, second and fifth capacitors being the coupling capacitors;

the sixth, seventh and eighth capacitors being grounded capacitors;

the first resonator electrode having one-side end connected to the input terminal via the third capacitor and grounded via the sixth capacitor, and the other-side end directly grounded;

the second resonator electrode having one-side end grounded via the seventh capacitor and the other-side end directly grounded;

the third resonator electrode having one-side end directly grounded, and the other-side end connected to the output terminal via the fourth capacitor and grounded via the eighth capacitor;

one-side end of the second resonator electrode being connected to the input terminal via the first capacitor;

the other-side end of the second resonator electrode being connected to the output terminal via the second capacitor; and one-side end of the first resonator electrode being connected to one-side end of the third resonator electrode via the fifth capacitor.

The laminated bandpass filter according to a further embodiment of the present invention comprises an input terminal, an output terminal, and first to sixth capacitors, the first resonator electrode having one-side end connected to the input terminal via the first capacitor and grounded via the fourth capacitor, and the other-side end directly grounded;

the second resonator electrode having one-side end grounded via the fifth capacitor and the other-side end directly grounded;

the third resonator electrode having one-side end directly grounded, and the other-side end connected to the output terminal via the second capacitor and grounded via the sixth capacitor; and the other-side end of the third resonator electrode being connected to the input terminal via the third capacitor.

The input terminal and the output terminal may be connected via a seventh capacitor. At least part of electrodes constituting at least one of the fourth to sixth capacitors is preferably sandwiched by the ground electrodes.

The high-frequency component of the present invention comprises a laminate of pluralities of dielectric layers provided with electrode patterns and devices mounted on a surface of the laminate to constitute a high-frequency circuit used in communications apparatuses, the high-frequency circuit comprising any one of the above laminated bandpass filters.

The communications apparatus of the present invention comprises the above high-frequency component.

BRIEF DESCRIPTION OF THE DRAWINGS

FIG. 3(*b*) is a view showing the overlapping of jump capacitor electrodes and resonator electrodes.

FIG. 4(*b*) is an enlarged perspective view showing the overlapping of transmission lines and interstage capacitor electrodes in the laminated bandpass filter in the second embodiment.

FIG. 10(*b*) is an enlarged view showing another example of resonator electrodes, which is constituted by transmission lines formed on the sixth to eighth layers in the laminated bandpass filter of FIG. 9.

DESCRIPTION OF THE PREFERRED EMBODIMENTS

[1] Laminated Bandpass Filter

The laminated bandpass filter according to each embodiment of the present invention will be explained in detail referring to the attached drawings, though it is not restricted thereto. Explanations in each embodiment are valid in other embodiments unless otherwise mentioned. It should be noted that "one-side" and "the other-side" correspond to an upper side and a lower side in FIGS. 1, 6, 8 and 12.

The laminated bandpass filter of the present invention comprises three-stage resonator, and three resonator electrodes are formed in a laminate, with adjacent resonator electrodes electromagnetically coupled. The three-stage resonator provides steep attenuation characteristics. Additional resonators may be added to provide the laminated bandpass filter with a 3-or-more-stage resonator. However, because a larger number of stages make the laminated bandpass filter larger with increased insertion loss, the three-stage resonator is preferable.

Among three resonator electrodes, each of two adjacent resonator electrodes has one-side end connected to a grounded capacitor and the other-side end directly grounded. A remaining resonator electrode has one end directly grounded and the other end connected to a grounded capacitor, opposite to the two adjacent resonator electrodes. Namely, two adjacent resonator electrodes are oriented in the same direction, and a remaining resonator electrode is oriented in an opposite direction. The term "directly grounded" used herein means grounded via no capacitor, and the term "opposite direction" used herein means opposite in a grounding direction. The "connection" includes not only direct connection or connection through via-holes, but also capacitive coupling. The end of an electrode means an end or its nearby region of an electrode.

(1) First Embodiment

Figure 1:
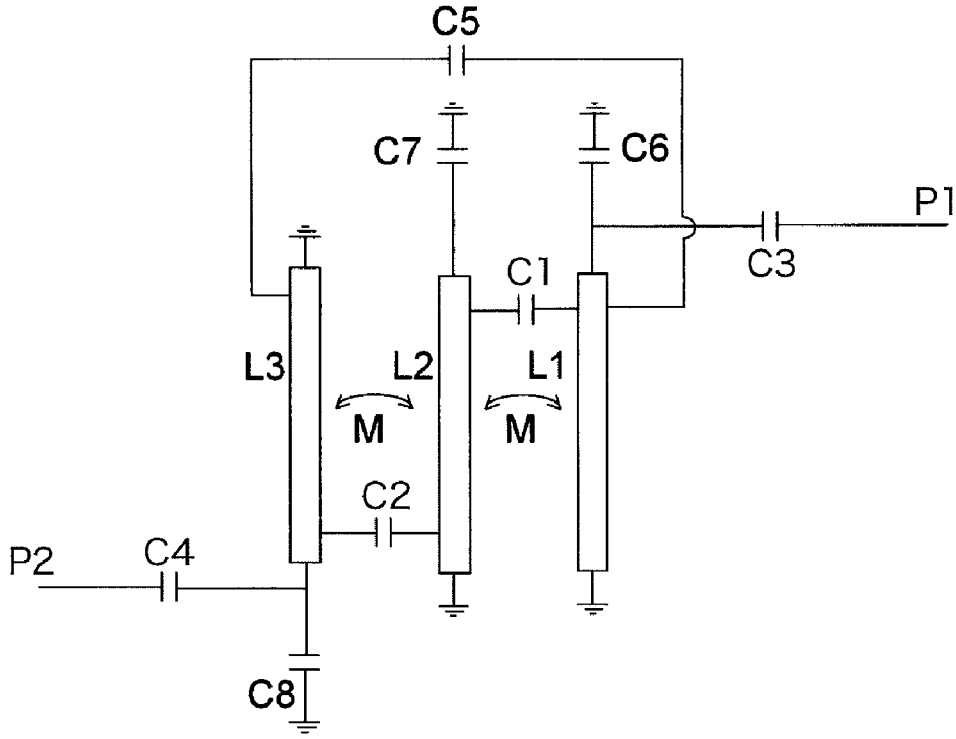
FIG. 1 is a view showing the equivalent circuit of a laminated bandpass filter according to the first embodiment of the present invention.

FIG. 1 shows the laminated bandpass filter in the first embodiment. A coupling capacitor formed between resonator electrodes is an interstage capacitor formed between adjacent resonator electrodes, or a jump capacitor formed between resonator electrodes on both sides. A coupling-capacitor electrode extends over the resonator electrodes. The words "extend over the resonator electrodes" used herein mean that the coupling-capacitor electrode extends over two or more resonator electrodes such that they are overlapping. When viewed in a lamination direction, the coupling capacitor overlaps two or more resonator electrodes via no ground electrode. Particularly when one capacitor electrode overlaps two or more resonator electrodes, there is large connecting capacitance because of a large overlapping area, thereby providing a laminated bandpass filter with small insertion loss, and large attenuation on both low-frequency and high-frequency sides. Also, because the capacitor electrode directly opposes a resonator electrode via no ground electrode to form a coupling capacitor, the laminated bandpass filter can be miniaturized.

The laminated bandpass filter shown in FIG. 1 comprises an input terminal P1, an output terminal P2, pluralities of capacitor electrodes C1-C8, and pluralities of (three) resonator electrodes L1-L3, which are electromagnetically coupled to constitute a three-stage resonator. The first and second resonator electrodes L1, L2 are adjacently arranged to have electromagnetic coupling, and the second and third resonator electrodes L2, L3 are adjacently arranged to have electromagnetic coupling. The electromagnetic coupling is shown by a symbol "M" in FIG. 1. Among the three resonator electrodes L1-L3, two adjacent resonator electrodes L1, L2 are connected to a ground electrode preferably in the same direction, while one resonator electrode L3 in an opposite direction. The other-side ends of the two adjacent resonator electrodes L1, L2 are directly connected to the ground electrode, and one-side end of the resonator electrode L3 is directly connected to the ground electrode.

One-side end of the first resonator electrode L1 is connected to the input terminal P1 via the third capacitor C3, and grounded via the sixth capacitor C6. The other-side end of the first resonator electrode L1 is directly grounded (via substantially no capacitor). The second resonator electrode L2 has one-side end grounded via the seventh capacitor C7, and the other-side end directly grounded (via substantially no capacitor). The third resonator electrode L3 has one-side end directly grounded (via substantially no capacitor), and the other-side end connected to the output terminal P2 via the fourth capacitor C4 and grounded via the eighth capacitor C8. One-side end of the first resonator electrode L1 is connected to one-side end of the second resonator electrode L2 via the first capacitor C1, and the other-side end of the second resonator electrode L2 is connected to the other-side end of the third resonator electrode L3 via the second capacitor C2. Further, one-side end of the first resonator electrode L1 is connected to one-side end of the third resonator electrode L3 via the fifth capacitor C5. The first, second and fifth capacitors C1, C2 and C5 are coupling capacitors formed between resonator electrodes, and the sixth to eighth capacitors C6-C8 are grounded capacitors each connected to one side of each resonator electrodes L1-L3. The first and second capacitors C1, C2 are interstage capacitors formed between the adjacent resonator electrodes L1, L2 and L2, L3. The fifth capacitor C5 is a jump capacitor formed between the first resonator electrode L1 and the third resonator electrode L3 by jumping the second resonator electrode L2. The laminated bandpass filter circuit having this structure has excellent attenuation characteristics.

The first resonator electrode L1 is connected to the input terminal P1, and the third resonator electrode L3 is connected to the output terminal P2 in this embodiment, but the present invention is not restricted thereto, but the first resonator electrode L1 may be connected to the output terminal P2, and the third resonator electrode L3 may be connected to the input terminal P1. The same is true in other embodiments.

Figure 2:
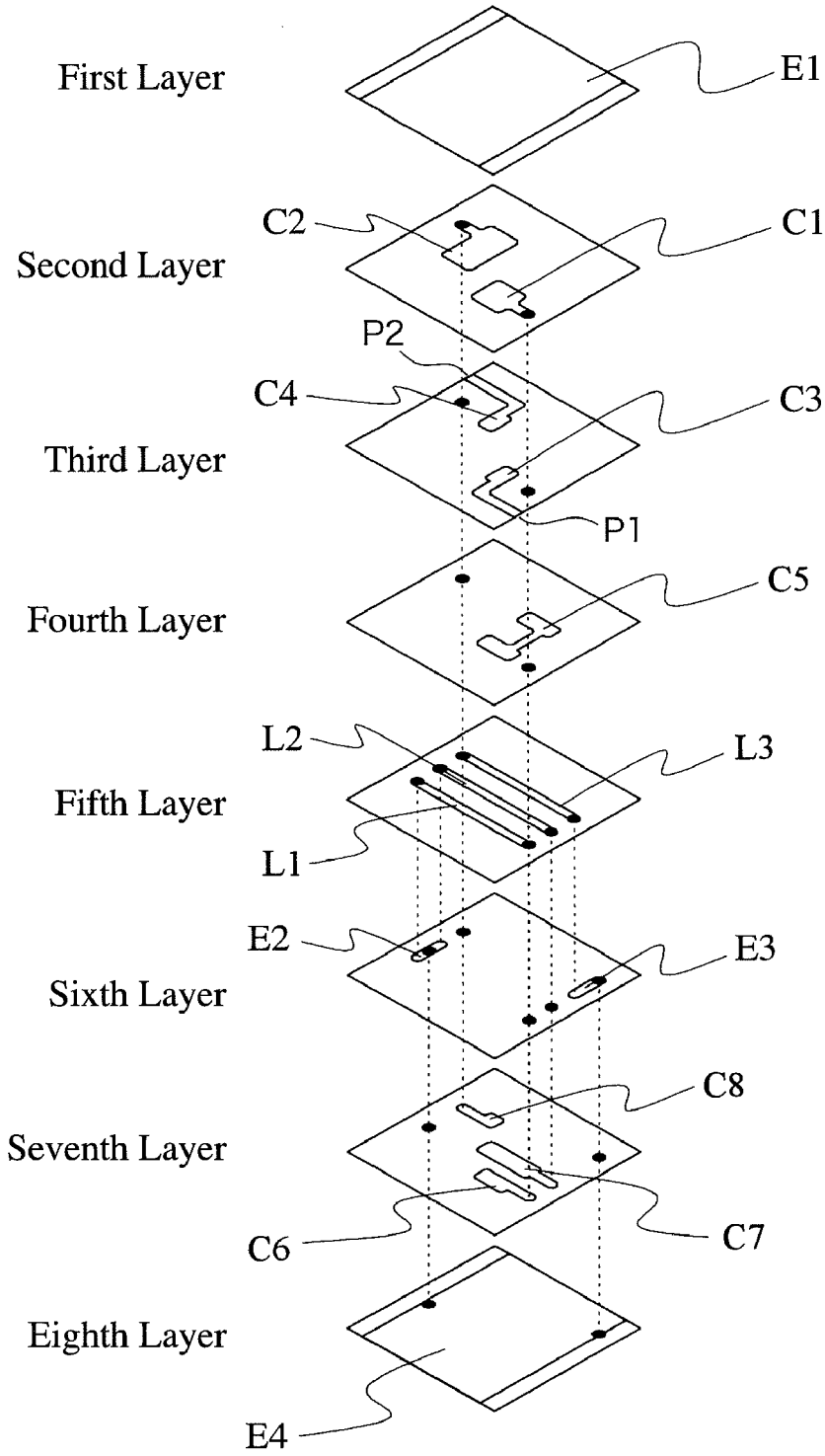
FIG. 2 is an exploded perspective view showing electrode patterns on layers in the laminated bandpass filter in the first embodiment.

The laminated bandpass filter having such equivalent circuit is shown in FIG. 2. Black circles indicate via-holes, and broken lines indicate connections between the via-holes. The symbols of electrodes in FIG. 2 are the same as those of the corresponding capacitors and resonator electrodes in FIG. 1.

The lowermost layer (eighth layer) has a ground electrode E4, and the seventh layer has grounded, strip-shaped capacitor electrodes C6, C7, C8 extending along the resonator electrodes L1-L3. Each capacitor electrode C6, C7, C8 has larger width in an intermediate portion apart from the end of each resonator electrodes L1-L3, thereby adjusting capacitor. The capacitor electrodes C6, C7 corresponding to the resonator electrodes L1, L2 are wider on the opposite side to the capacitor electrode C8. Not restricted to a case where the grounded capacitor electrode and the ground electrode are opposing as shown in FIG. 2, one-side or the other-side end of the resonator electrodes L1-L3 may be opposing the ground electrode.

The sixth layer has small-area electrodes E2, E3 at positions corresponding to both ends of the resonator electrodes L1-L3. Each electrode E2, E3 has a shape designed to increase bandwidth. The electrode E2 is a short electrode laterally extending from a center via-hole, through which it is connected to the end of each resonator electrode L1, L2. Both ends of the resonator electrodes L1, L2 are grounded via extremely small inductance, resulting in large passband flatness and a wide band. The center via-hole of the electrode E2 is preferably at a middle position between the resonator electrodes L1, L2. The electrode E3 disposed on the opposite side of the electrode E2 acts similarly.

The fifth layer has three, parallel, strip-shaped resonator electrodes L1-L3 having the same length. The resonator electrodes L1-L3 may be displaced longitudinally, and may have different lengths and widths. Further, the resonator electrodes L1-L3 may not be straight, but may be curved in other portions than the electromagnetically coupled portions. The width of the resonator electrodes L1-L3 may be about 0.5-2 times the diameter of the via-electrodes. The resonator electrodes L1-L3 are formed by transmission lines, part of which may be inductors. The other-side ends (upper left side in the figure) of the adjacent resonator electrodes L1, L2 are connected to the ground electrode E4 on the lowermost layer (eighth layer) through via-holes and the electrode E2 on the sixth layer. One-side end (lower right side in the figure) of one resonator electrode L3 is connected to the ground electrode E4 on the lowermost layer through a via-hole and the electrode E3 on the sixth layer. The grounding direction of the resonator electrode L3 is opposite to that of the adjacent resonator electrodes L1, L2, thereby providing a small laminated bandpass filter with small insertion loss and large attenuation on both low-frequency and high-frequency sides.

Figure 3A:
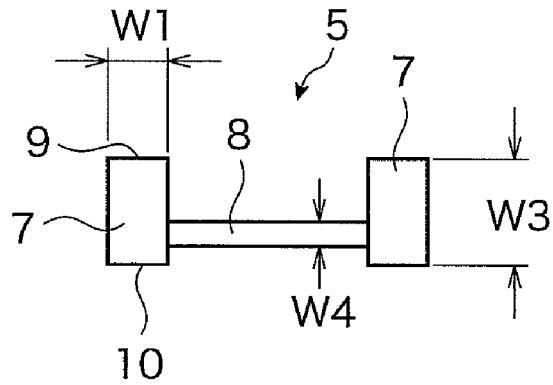
FIG. 3(*a*) is an enlarged view showing electrodes for a jump capacitor.
Figure 3B:
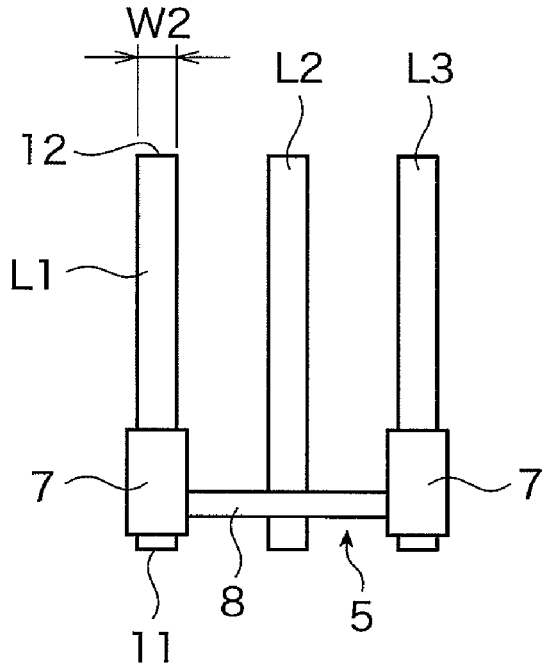

The fourth layer has a substantially H-shaped electrode constituting the fifth capacitor (jump capacitor) C5. Of course, the jump capacitor electrode is not restricted to be in an H shape, but may be in another shape such as a U shape, etc. As shown in FIGS. 2 and 3, the electrode of the jump capacitor C5 integrally comprises opposing, substantially rectangular electrodes 7, 7 longitudinally extending such that they overlap the resonator electrodes L1, L3 on the same side, and a connecting electrode 8 extending perpendicularly from the resonator electrode L2 to connect the opposing electrodes 7, 7 on the same side of the resonator electrodes L1, L3. As shown in FIG. 1, this structure constitutes the jump capacitor C5 connecting one-side end (on the grounded capacitor side) of the resonator electrode L1 to one-side end (on the directly grounded side) of the resonator electrode L3, thereby providing capacitive coupling between both ends, and thus steep attenuation characteristics on the higher- or lower-frequency side of a passband. The opposing electrodes 7 are not restricted to be disposed at the position shown in FIG. 2, but may be formed near the other-side ends of the resonator electrodes L1, L3. With the jump capacitor C5 formed without bypassing the center resonator electrode L2, the laminated bandpass filter can be miniaturized.

As shown in FIGS. 2 and 3, both ends 9, 10 of each opposing electrode 7 are positioned inside both ends 11, 12 of the resonator electrodes L1, L3. This structure suppresses the variation of characteristics due to the displacement of the opposing electrodes 7, 7 along the longitudinal direction of the resonator electrodes L1, L3. Because the connecting electrode 8 is positioned inside both ends 9, 10 of the opposing electrodes 7, the variation of characteristics due to the displacement of the connecting electrode 8 along the longitudinal direction of the resonator electrodes L1, L3 can be suppressed. This structure is suitable when the resonator electrodes L1-L3 have different lengths, particularly when the center resonator electrode L2 is shorter than the resonator electrodes L1, L2 on both sides. The connecting electrode 8 need only be positioned inside both ends of at least one of the opposing electrodes 7.

As shown in FIG. 3(*b*), when the width W1 of the opposing electrodes 7 is equal to or more than the width W2 of the resonator electrodes L1, L3 on both sides, sufficient overlap can be kept even if they are displaced to some extent, thereby suppressing capacitance unevenness. When the width W4 of the connecting electrode 8 is less than the length W3 of the opposing electrodes, unnecessary capacitance can be suppressed between the connecting electrode 8 and the center resonator electrode L2. Further, when the width W4 of the connecting electrode 8 is equal to or less than the width of the center resonator electrode L2, there is small unnecessary capacitance between the connecting electrode 8 and the center resonator electrode L2, resulting in improved attenuation characteristics. This structure is suitable when the connecting electrode 8 overlaps the center resonator electrode L2. The width W4 of the connecting electrode 8 may be constant or different longitudinally. When the width W4 of the connecting electrode 8 is different longitudinally, the width W4 is represented by the maximum width at an intersection with the center resonator electrode L2.

Figure 4A:
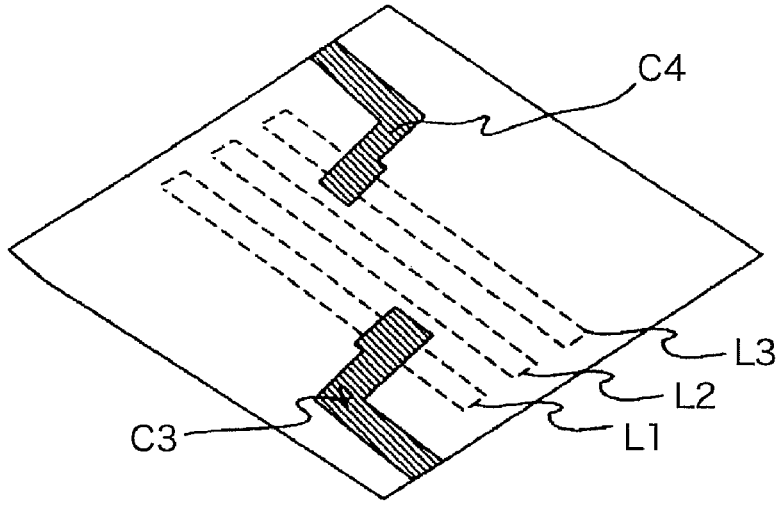
FIG. 4(*a*) is an enlarged perspective view showing the overlapping of transmission lines and interstage capacitor electrodes in FIG. 2.
Figure 4B:
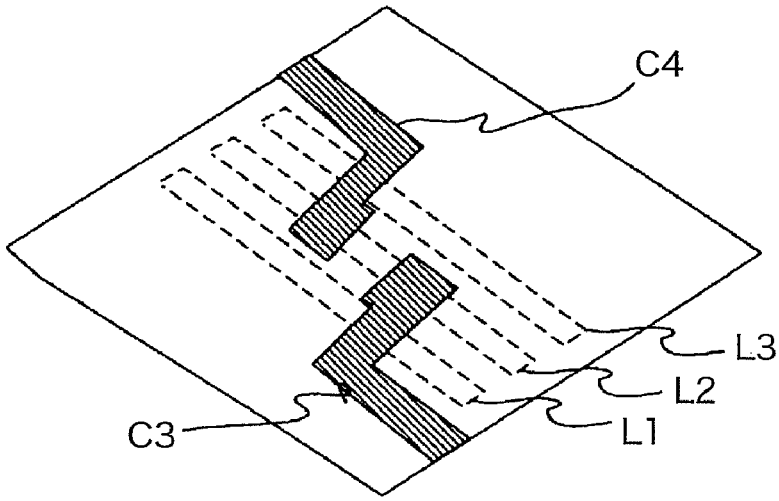

The third layer has an input terminal P1, an output terminal P2, an electrode constituting the capacitor C3 (input-side capacitor) coupling the input terminal P1 and the resonator electrode L1, and an electrode constituting the capacitor C4 (output-side capacitor) coupling the output terminal P2 and the resonator electrode L3. Because the resonator electrodes L1, L3 on both sides are oriented oppositely, the input terminal and the output terminal can be arranged apart at both ends of the laminated bandpass filter. Accordingly, sufficient isolation is secured between the input terminal and the output terminal. FIG. 4(*a*) shows the overlapping of the capacitor electrodes C3, C4 and the resonator electrodes L1, L2. The capacitor electrode C3 is constituted by a straight portion extending from the input terminal P1 toward the resonator electrode L1, and a portion extending perpendicularly from the straight portion to overlap the resonator electrode L1. The overlapping of the capacitor electrode C3 and the resonator electrode L1 constitutes the input-side capacitor C3. The capacitor electrode C4 is constituted by a straight portion extending from the output terminal P2 toward the resonator electrode L3, and a portion extending perpendicularly from the straight portion to overlap the resonator electrode L3. The overlapping of the capacitor electrode C4 and the resonator electrode L3 constitutes the output-side capacitor C4.

The second layer has a substantially rectangular electrode constituting an interstage capacitor C1 between the resonator electrode L1 and the resonator electrode L2, and a substantially rectangular electrode constituting an interstage capacitor C2 between the resonator electrode L2 and the resonator electrode L3. The capacitor electrode C1 overlaps one-side end of each resonator electrode L1, L2, and the capacitor electrode C2 overlaps the other-side end of each transmission line L2, L3. Namely, interstage capacitors C1, C2 are arranged on the longitudinally opposite sides of the resonator electrodes.

The first layer has a ground electrode E1. The first to eighth layer sheets are integrally laminated to form the laminated bandpass filter. In the structure shown in FIG. 2, the interstage capacitor electrodes C1, C2 and the jump capacitor electrode C5 are formed on the second and fourth layers above the fifth layer having resonator electrodes L1-L3, and the grounded capacitor electrodes C6-C8 are formed on the seventh layer below the fifth layer, making band adjustment easy.

Because electrodes opposing the ground electrodes E1, E4 to form capacitors are arranged between the resonator electrodes L1-L3 and the ground electrode E1, and between the resonator electrodes L1-L3 and the ground electrode E4, the resonator electrodes L1-L3 are isolated from the ground electrodes E1, E4. Because the capacitor electrodes C3, C4 are arranged between the ground electrode E1 and the resonator electrodes L1-L3, and because the capacitor electrodes C1, C2 are arranged between the capacitor electrodes C3, C4 and the ground electrode E1, parasitic capacitance with the ground can be suppressed in forming the capacitors C3, C4 having a DC-cutting function. Further, because the jump capacitor electrode C5 is formed between the capacitor electrodes C3, C4 and the resonator electrodes L1-L3, the jump capacitor electrode C5 directly opposes the resonator electrodes L1-L3, thereby reducing the area of an electrode necessary for forming the jump capacitor. The structure shown in FIG. 2 has a simpler electrode arrangement with shorter circuit lines than those of conventional laminated bandpass filters, resulting in reduced insertion loss.

Figure 5:
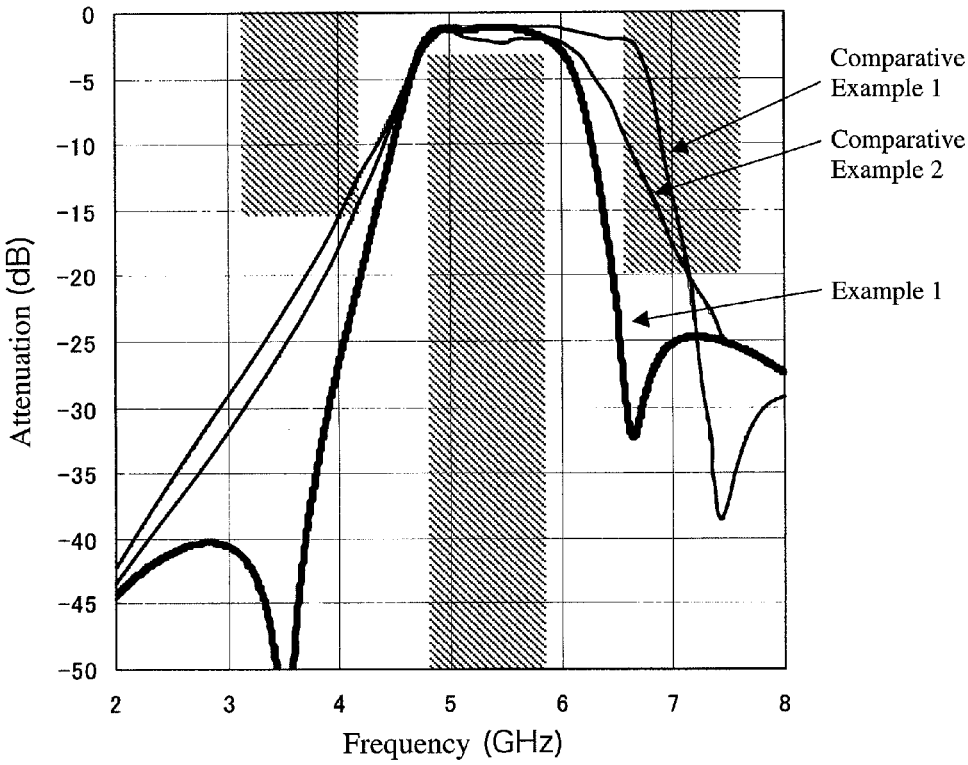
FIG. 5 is a graph showing the attenuation characteristics of the laminated bandpass filters of Example 1 and Comparative Examples 1 and 2.

FIG. 5 shows the attenuation characteristics of the laminated bandpass filter in the first embodiment (Example 1), the laminated bandpass filter of Comparative Example 1 in which all three resonator electrodes L1-L3 are grounded on the same one-side end, and the laminated bandpass filter of Comparative Example 2 in which only a center resonator electrode L2 among three resonator electrodes L1-L3 is grounded on the opposite side (the center resonator electrode L2 is oppositely directed). Comparative Example 2 is the same as the laminated bandpass filter described in JP 2006-166136 A. In FIG. 5, hatched portions indicate the standard required for laminated bandpass filters. The laminated bandpass filter of Example 1 has steep attenuation characteristics on both sides of the passband, while both of Comparative Examples 1 and 2 fail to meet the required standard.

(2) Second Embodiment

Figure 6:
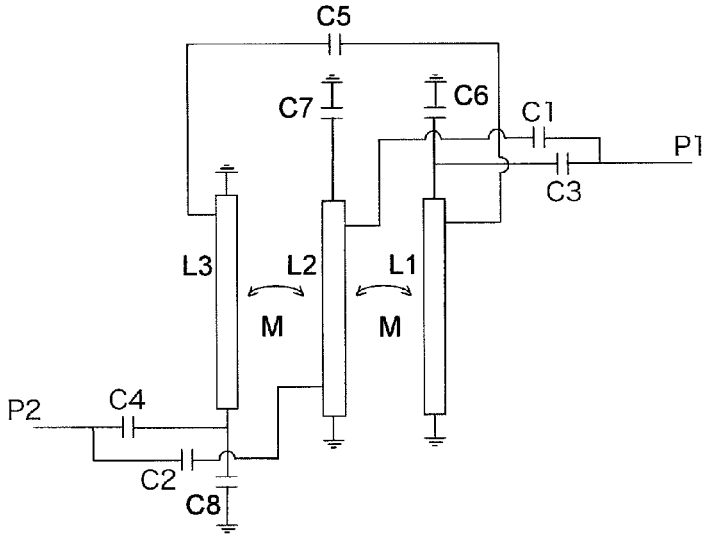
FIG. 6 is a view showing the equivalent circuit of a laminated bandpass filter in the second embodiment.

The laminated bandpass filter in the second embodiment shown in FIG. 6 differs from the laminated bandpass filter shown in FIG. 1, only in that one end of the first interstage capacitor C1 is connected to the input terminal P1, and that one end of the second interstage capacitor C2 is connected to the output terminal P2. Accordingly, explanation will be omitted except for the interstage capacitors C1, C2. The laminated bandpass filter circuit having this structure also has excellent attenuation characteristics.

The laminated bandpass filter in the second embodiment is the same as the laminated bandpass filter in the first embodiment except that it has a different third layer structure. The capacitor electrodes on the third layer in the laminated bandpass filter in the first embodiment are shown in FIG. 4(*a*), and the capacitor electrodes on the third layer in the laminated bandpass filter in the second embodiment are shown in FIG. 4(*b*). Unlike the laminated bandpass filter in the first embodiment, the input capacitor electrode C3 extends over the first resonator electrode L1 and the second resonator electrode L2, and the output capacitor electrode C4 extends over the second resonator electrode L2 and the third resonator electrode L3 in the laminated bandpass filter in the second embodiment.

The input and output capacitor electrodes C3, C4 extending to the second resonator electrode L2 form the input and output capacitors C3, C4 directly connected to the terminals P1, P2 and interstage capacitors C1, C2. As shown in FIG. 6, with the capacitive coupling of the input capacitor electrode C3 and two adjacent resonator electrodes L1, L2, the second resonator electrode L2 is coupled to the first resonator electrode L1 via the interstage capacitor C1 and the input capacitor C3. Also, with the capacitive coupling of the output capacitor electrode C4 and two adjacent resonator electrodes L3, L2, the second resonator electrode L2 is coupled to the third resonator electrode L3 via the interstage capacitor C2 and the output capacitor C4. Namely, an electrode for the input capacitor C3 forms the capacitor C1 between the first resonator electrode L1 and the second resonator electrode L2, and an electrode for the output capacitor C4 forms the capacitor C2 between the second resonator electrode L2 and the third resonator electrode L3. This structure provides further improved attenuation characteristics.

(3) Third Embodiment

Figure 7:
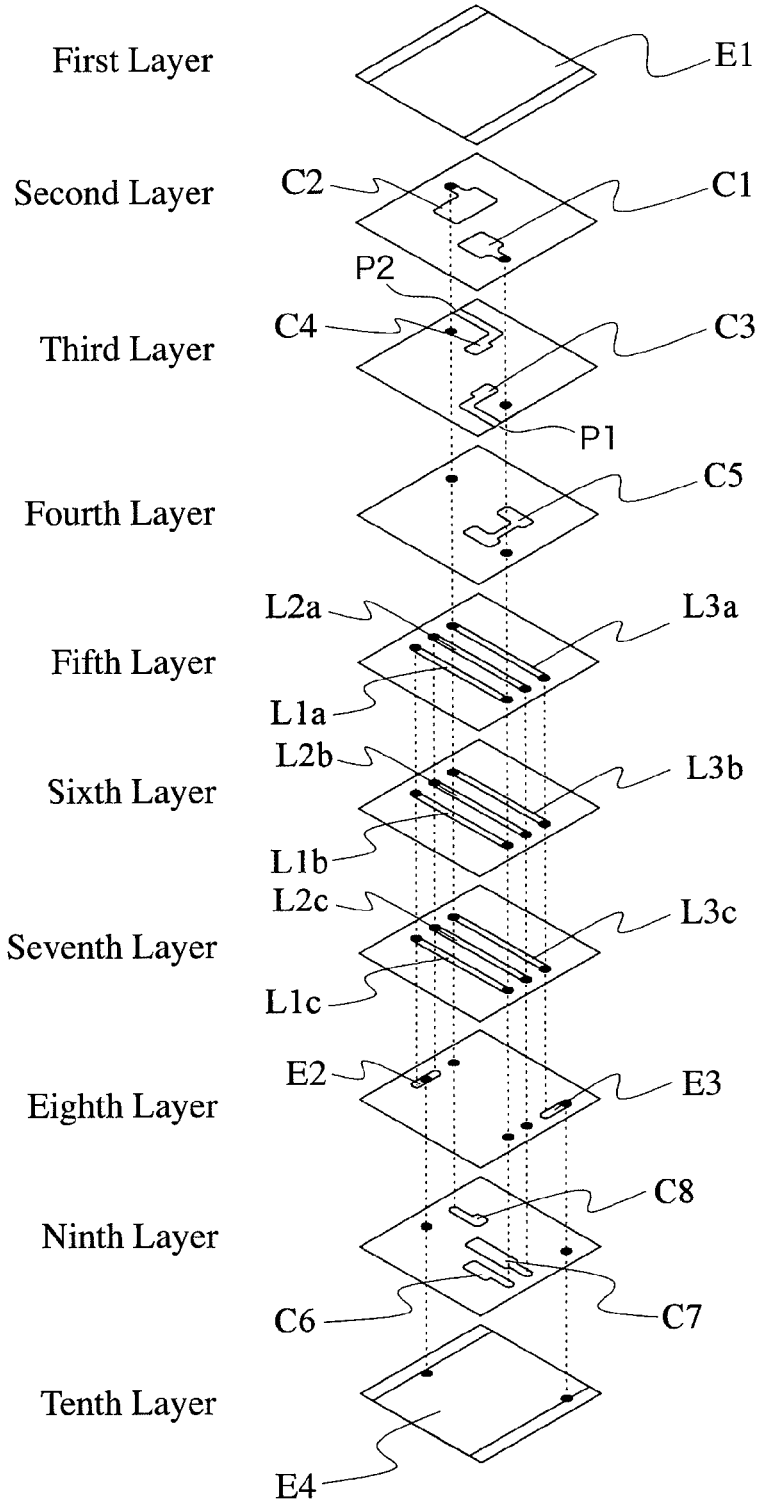
FIG. 7 is an exploded perspective view showing electrode patterns on layers in a laminated bandpass filter according to the third embodiment of the present invention.

The laminated bandpass filter in the third embodiment shown in FIG. 7 has 10 layers, different from the laminated bandpass filter shown in FIG. 2 in that three resonator electrodes are separately formed on three layers (fifth to seventh layers). Accordingly, explanation will be omitted except for the fifth to seventh layers. The fifth layer has first transmission lines (L1*a*, L2*a*, L3*a*) for constituting the resonator electrodes L1-L3, the sixth layer has second transmission lines (L1*b*, L2*b*, L3*b*) for constituting the resonator electrodes L1-L3, and the seventh layer has third transmission lines (L1*c*, L2*c*, L3*c*) for constituting the resonator electrodes L1-L3. The transmission lines L1*a*, L1*b*, L1*c* are parallel-connected through via-holes to form a resonator electrode L1, the transmission lines L2*a*, L2*b*, L2*c* are parallel-connected through via-holes to form a resonator electrode L2, and the transmission lines L3*a*, L3*b*, L3*c* are parallel-connected through via-holes to form a resonator electrode L3. The parallel connection of electrodes on pluralities of layers reduces impedance, providing the laminated bandpass filter with small insertion loss. Although each resonator electrode is divided to three in this embodiment, it may of course be divided to two or four or more. Gaps between the resonator transmission lines are preferably smaller in a lamination direction than in a planar direction (perpendicular to the lamination direction).

Grounded capacitor electrodes C6-C8 are formed below the seventh layer having the transmission lines L1*c*, L2*c*, L3*c* for the resonator. Interstage capacitor electrodes C3, C4 and a jump capacitor electrode C5 are formed above the fifth layer having transmission lines L1*a*, L2*a*, L3*a* for the resonator.

(4) Fourth Embodiment

Figure 8:
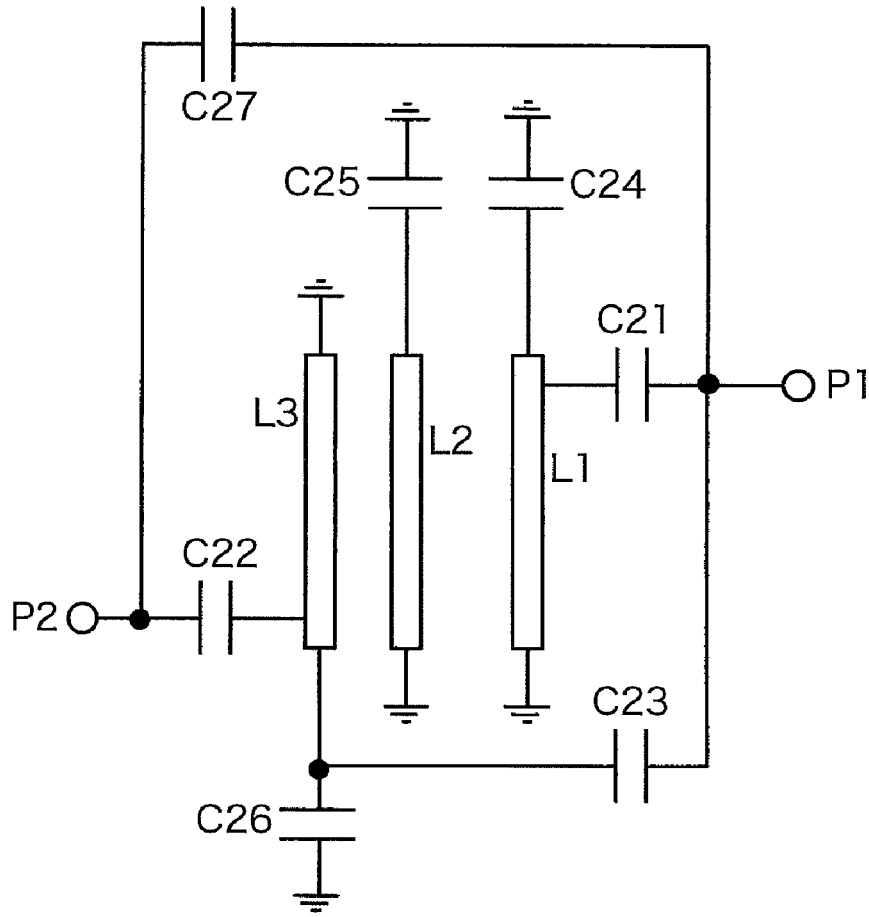
FIG. 8 is a view showing the equivalent circuit of a laminated bandpass filter according to the fourth embodiment of the present invention.
Figure 10A:
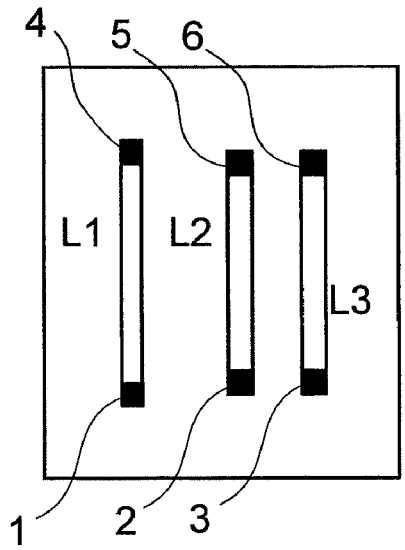
FIG. 10(*a*) is an enlarged view showing one example of resonator electrodes, which is constituted by transmission lines formed on the sixth to eighth layers in the laminated bandpass filter of FIG. 9.
Figure 10B:
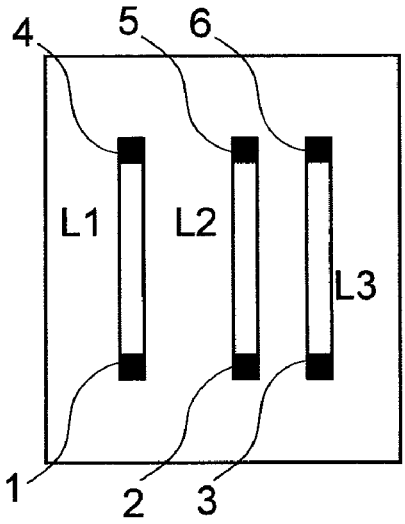

The laminated bandpass filter shown in FIG. 8 comprises an input terminal P1, an output terminal P2, first to seventh capacitors C21-C27, and first to third resonator electrodes L1-L3. As is clear from FIG. 10(*a*) showing the overlapped sixth to eighth layers, a gap between the resonator electrodes L1, L2 is wider than a gap between the resonator electrodes L2, L3 in this embodiment. In FIG. 10, black portions 1-6 are the ends of the resonator electrodes L1-L3 connected to via-electrodes. Because gaps between the electromagnetically coupled resonator electrodes are changed to adjust filter characteristics, the size and shape of resonator electrodes need not be changed largely. The distance from the resonator electrode L1 to the resonator electrode L3 can be reduced from conventional 1.0 mm to 0.9 mm in this example, thereby miniaturizing the laminated bandpass filter. Depending on the adjustment of the filter characteristics, a gap between the resonator electrodes L1, L2 may be smaller than a gap between the resonator electrodes L2, L3. The width and length of resonator electrodes may be changed depending on the filter characteristics. The resonator electrode L1 is slightly narrower and longer than the resonator electrodes L2, L3 in the example shown in FIG. 10(*a*), and all resonator electrodes L1-L3 have the same width and length in the example shown in FIG. 10(*b*). The gap between the resonator electrodes is a gap between electromagnetically coupled portions.

One-side end of the first resonator electrode L1 is connected to the input terminal P1 via the first capacitor C21, and grounded via the fourth capacitor C24. The other-side end of the first resonator electrode L1 is grounded via substantially no capacitor. The second resonator electrode L2 has one-side end grounded via the fifth capacitor C25, and the other-side end grounded via substantially no capacitor. The other-side end of the third resonator electrode L3 is connected to the output terminal P2 via the second capacitor C22, connected to the input terminal P1 via the third capacitor C23, and grounded via the sixth capacitor C26. One-side end of the third resonator electrode L3 is grounded via substantially no capacitor. Accordingly, a connecting point of the input terminal P1 and the capacitor C21 is connected to a connecting point of the resonator electrode L3 and the capacitor C26 via the capacitor C23, which is a jump capacitor formed between the first resonator electrode L1 and the third resonator electrode L3. Despite a simple circuit structure, the asymmetrically connected C23 gives high performance to the laminated bandpass filter while miniaturizing it. A jump capacitor C27 is connected between the input terminal P1 and the output terminal P2.

Because the capacitors C21, C22 can be formed by electrodes in the laminate, a new DC-cutting capacitor need not be added, thereby reducing the number of components and thus advantageous for the miniaturization of communications apparatuses. By adjusting the grounded capacitors C24, C25, C26 and/or the jump capacitor C27, the passband and attenuation pole of the laminated bandpass filter can be adjusted. The arrangement of other capacitors than the grounded capacitors C24-C26 may be changed depending on the filter characteristics. For instance, the capacitors C27 and C23 may be omitted. An interstage capacitor coupling the resonator electrodes L1, L2 and an interstage capacitor coupling the resonator electrodes L2, L3 may be added. Also, capacitor coupling the input terminal P1 and the transmission line L2, and capacitor coupling the output terminal P2 and the resonator electrode L2 may be added.

Figure 9:
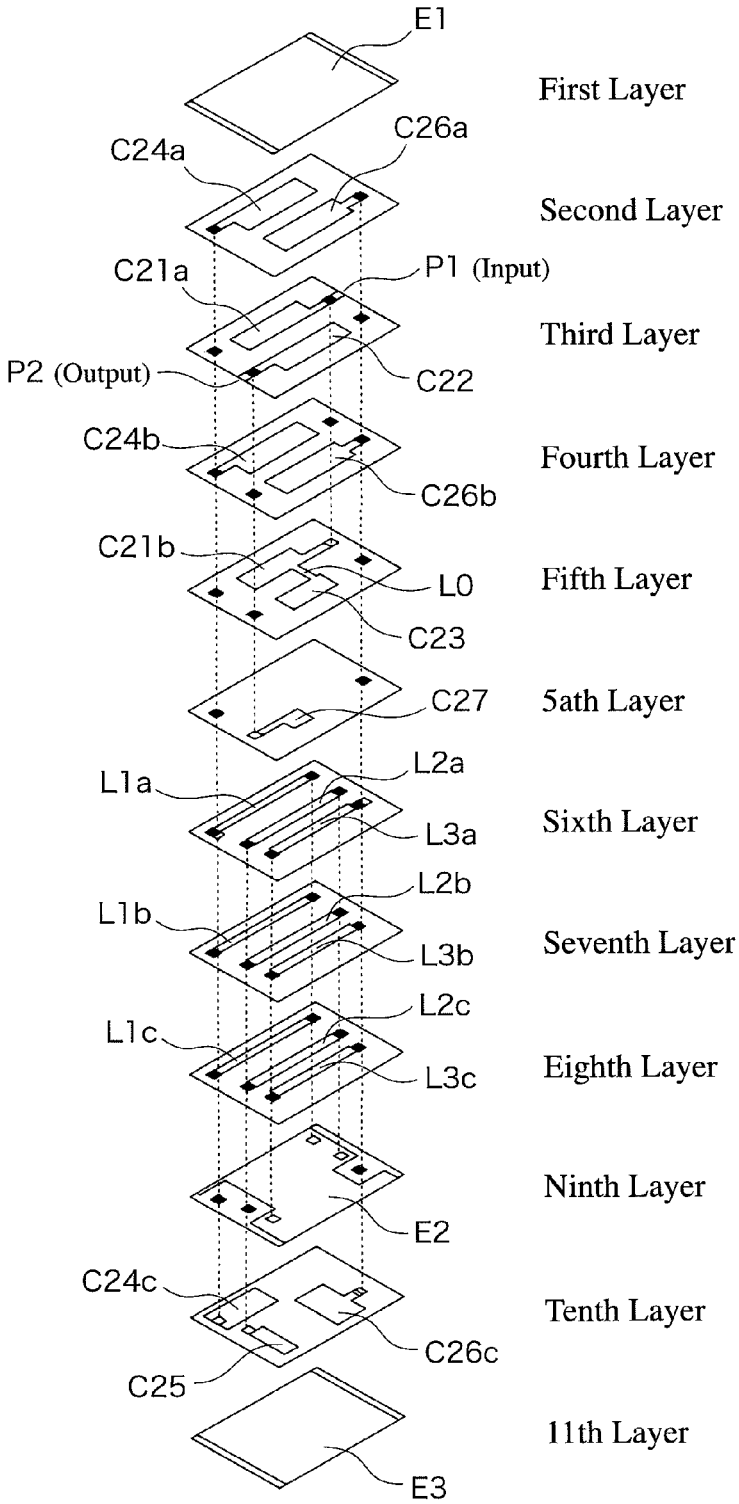
FIG. 9 is an exploded perspective view showing electrode patterns on layers in the laminated bandpass filter in the fourth embodiment.

FIG. 9 shows a laminated bandpass filter having the equivalent circuit shown in FIG. 8. Black squares indicate via-holes, and broken lines connecting the black squares in a lamination direction indicate the connection of via-holes. Ground electrodes E1, E3 on the first and eleventh layers minimize the influence of signals and noises from outside. The ground electrodes E1, E3 may be connected through external electrodes on the laminate side surfaces or via-electrodes in the laminate. Dielectric sheets may be laminated outside the first and eleventh layers to prevent the ground electrodes E1, E3 from exposing to the surface.

Electrodes C21*a*, C22, C24*a*, C24*b*, C26*a*, C26*b* on the second to fourth layers constitute capacitors C21, C22, and part of capacitors C24, C26. The capacitors C21, C22 are formed by electrodes C21*a*, C22 sandwiched by electrodes for capacitors C24, C26 on upper and lower layers. When the laminate is viewed from above, the electrode C21*a* is preferably located inside the electrodes C24*a* and C24*b*, and the electrode C22 is preferably located inside the electrodes C26*a* and C26*b*. The electrode C21*a* is connected to the input terminal P1, and the electrode C22 is connected to the output terminal P2.

When the electrodes C21*a*, C22 are located outside the electrodes C24*a*, C24*b* and the electrodes C26*a*, C26*b*, parasitic capacitance is generated between them and the ground electrodes, making it difficult to have high-frequency matching. The input and output terminals P1, P2 are connected to external electrodes on the laminate side surfaces, though not restrictive.

The fifth layer has electrodes C21*b* and C23 constituting part of the capacitor C21. Because the electrodes C21*b* and C23 are connected through a connecting electrode L0, the coupling capacitor electrode C23 extends over the resonator electrodes. The electrodes C21*b* and C23 are formed on the same layer (fifth layer), contributing to reducing the height of the laminated bandpass filter. Because the resonator electrode L1 is connected to the electrode C24*b*, and because the resonator electrode L3 is connected to the electrode C26*b*, C21*b* and C23 may overlap the resonator electrodes L1, L3. It is preferable that the electrodes C21*b* and C23 do not overlap the resonator electrode L2, to reduce parasitic capacitance with the resonator electrode L2. The connecting electrode L0 connecting the electrodes C21*b* and C23 is preferably as wide as about 80-300 μm, narrower than the electrodes C21*b*, C23. When the connecting electrode L0 is narrower than this, there is large signal loss. When it is wider than this, there is large parasitic capacitance with the resonator electrode L2. An electrode C27 printed on the 5a-th layer preferably overlaps at least part of an electrode C23 printed on the fifth layer, when the laminate is viewed from above. The electrode C27 is formed on a new layer (5a-th layer) in the example shown in FIG. 9, but it may be formed on the second or fourth layer.

The sixth to eighth layers have resonator electrodes L1-L3. Like in FIG. 6, pluralities of transmission lines constituting resonator electrodes L 1-L3 are formed on pluralities of layers (sixth to eighth layers). In FIG. 9, the resonator electrodes L1, L2 are grounded on the upper right side, and the resonator electrode L3 is grounded on the lower left side, opposite to the resonator electrodes L1, L2. To improve high-frequency matching, attenuation characteristics and insertion loss, the length, width, etc. of the transmission lines may be adjusted. For instance, to have high-frequency matching, the resonator electrode L1 may be made narrower with the resonator electrode L3 made wider, or the resonator electrode L1 may be made longer with the resonator electrode L3 made shorter.

The ninth and eleventh layers have ground electrodes E2, E3, and the tenth layer has capacitor electrodes C24*c*, C25, C26*c* (forming part of capacitors C24-C26) sandwiched by the ground electrodes E2, E3. With the capacitor electrodes C24*c*, C25, C26*c* formed on the same layer, the laminated bandpass filter can be miniaturized. Also, with the capacitor electrodes C24*c*, C25, C26*c* sandwiched by the ground electrodes E2, E3, the capacitor electrodes can be made smaller, contributing to the miniaturization of the laminated bandpass filter. Further, with the ground electrode E2 arranged between the capacitor electrodes C24*c*, C25, C26*c* and the resonator electrodes L1-L3, unnecessary capacitance can be prevented between the capacitor electrodes C24*c*, C25, C26*c* and the resonator electrodes L1-L3. Accordingly, the electrodes for the capacitors C24-C26 have high degree of freedom in shape and arrangement. The laminate structure shown in FIG. 9 provides a laminated bandpass filter with excellent attenuation characteristics and easy mountability onto communications apparatuses.

Figure 11:
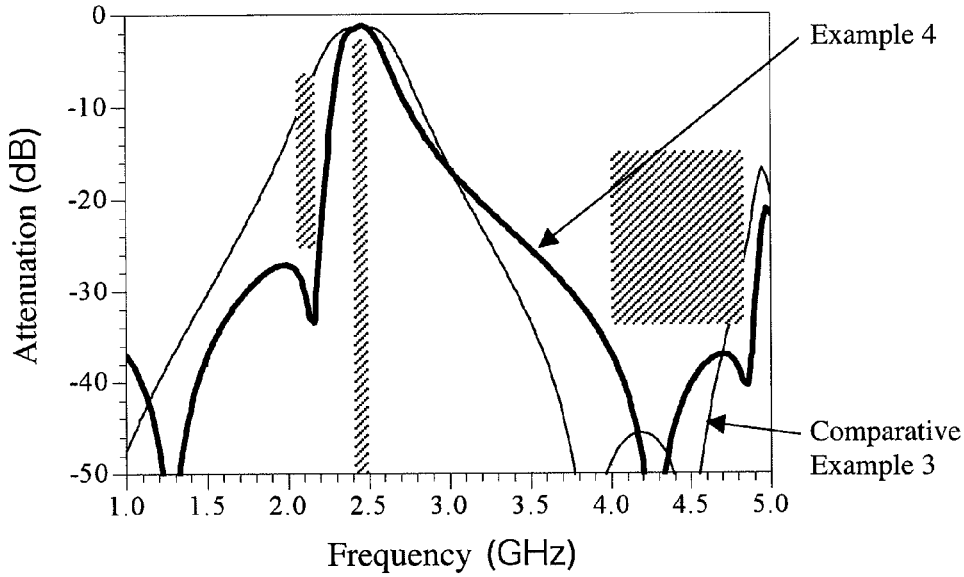
FIG. 11 is a graph showing the attenuation characteristics of the laminated bandpass filters of Example 4 and Comparative Example 3.
Figure 25:
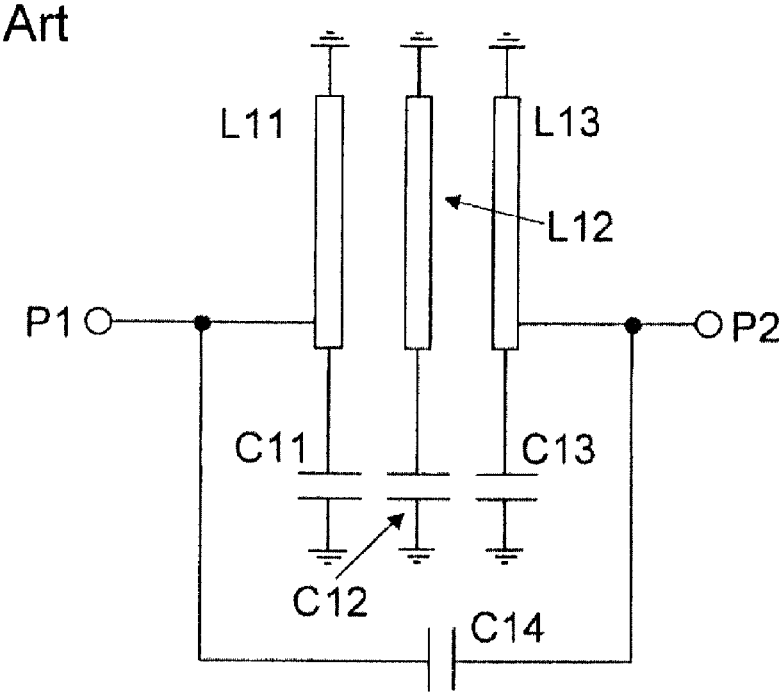
Fig. 25 Related Art
FIG. 25 is a view showing the equivalent circuit of a conventional laminated bandpass filter.

This laminated bandpass filter can be miniaturized to, for instance, 1.4 $mm^2$. FIG. 11 shows the attenuation characteristics of this laminated bandpass filter (Example 4), and a conventional laminated bandpass filter (Comparative Example 3) having the equivalent circuit shown in FIG. 25. Both filters have a 2.45-GHz passband. In FIG. 11, when an attenuation line overlaps the hatched portions, the attenuation does not reach the required level. With respect to insertion loss in a 2.45-GHz band and attenuation in a 5-GHz band, both filters are on substantially the same level. On the lower-frequency side (around 2.2 GHz) than 2.45 GHz, however, Example 4 reached the targeted attenuation, but Comparative Example 3 did not reach it.

(5) Fifth Embodiment

Figure 12:
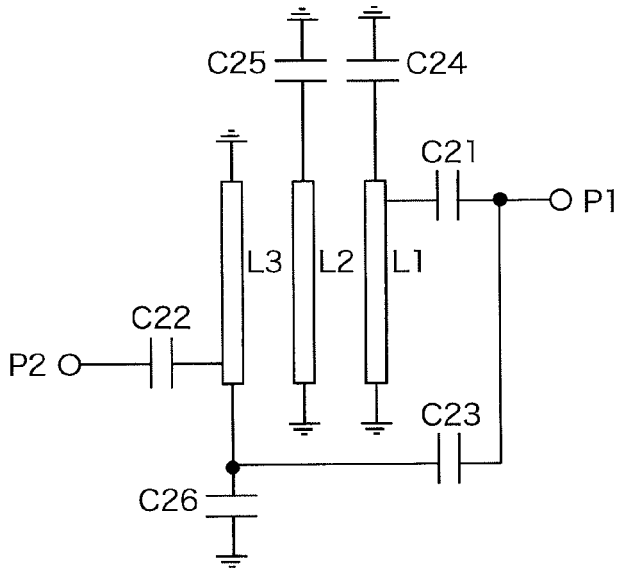
FIG. 12 is a view showing the equivalent circuit of a laminated bandpass filter according to the fifth embodiment of the present invention.
Figure 13:
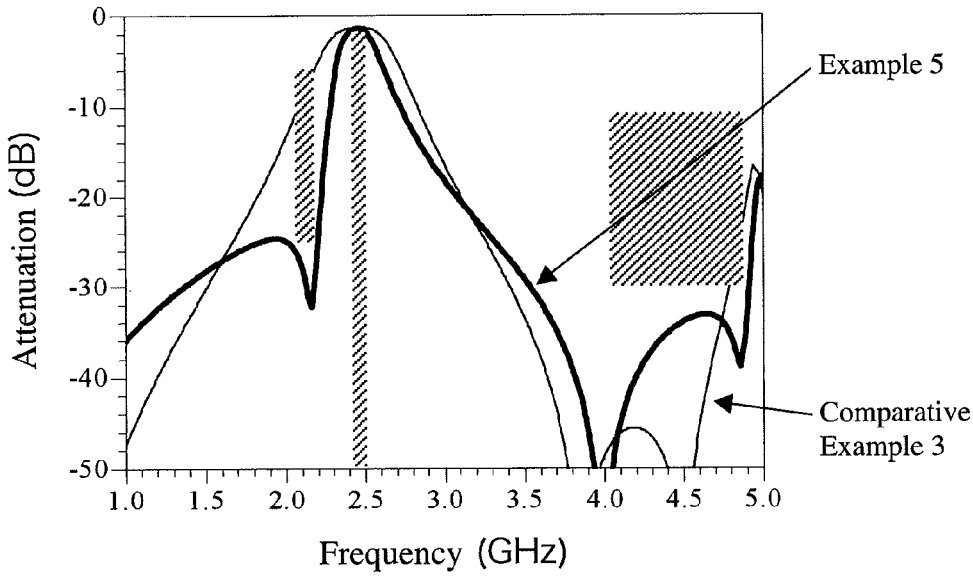
FIG. 13 is a graph showing the attenuation characteristics of the laminated bandpass filters of Example 5 and Comparative Example 3.

FIG. 12 shows the equivalent circuit of a laminated bandpass filter in the fifth embodiment. This laminated bandpass filter is the same as the laminated bandpass filter shown in FIG. 8, except that the jump capacitor C27 is not connected between the input terminal P1 and the output terminal P2. FIG. 13 shows the attenuation characteristics of the laminated bandpass filter in the fifth embodiment (Example 5) and a conventional laminated bandpass filter (Comparative Example 3) having the equivalent circuit shown in FIG. 25. The capacitors C11-C13 in FIG. 25 correspond to the capacitor C24-C26 in FIG. 12. These filters are operated at 2.45

GHz. In FIG. 13, when an attenuation line overlaps the hatched portions, the attenuation does not reach the required level. With respect to insertion loss in a 2.45-GHz band and attenuation in a 5-GHz band, both filters are on substantially the same level. On the lower-frequency side (around 2.2 GHz) than 2.45 GHz, however, Example 5 reached the targeted attenuation, but Comparative Example 3 did not reach it. The laminated bandpass filter of Example 5 can attenuate signals at around 2.2 GHz while keeping insertion loss in a 2.45-GHz band.

Figure 14:
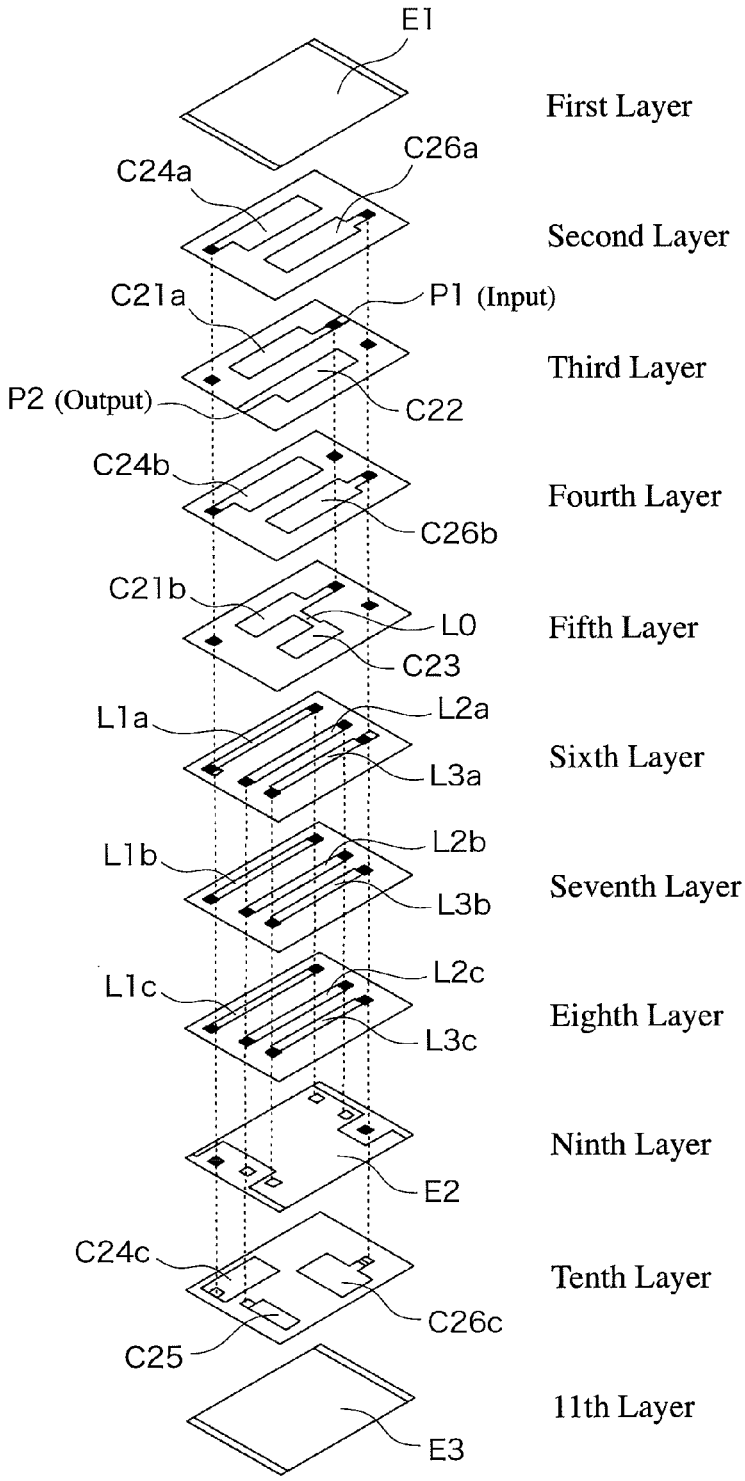
FIG. 14 is an exploded perspective view showing electrode patterns on layers in the laminated bandpass filter in the fifth embodiment.
Figure 15:
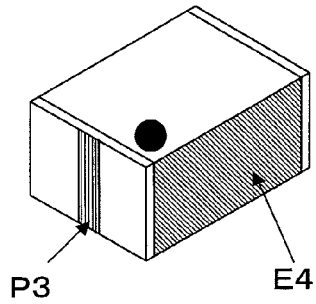
FIG. 15 is a perspective view showing the appearance of the laminated bandpass filter shown in FIG. 14.

FIG. 14 shows the laminate structure of the fifth laminated bandpass filter. Black squares indicate via-holes, and broken lines connecting the black squares in a lamination direction indicate the connection of the via-holes. Ground electrodes E1, E3 on the first and eleventh layers minimize the influence of signals and noises from outside. FIG. 15 shows the appearance of this laminated bandpass filter. The laminated bandpass filter comprises input/output terminals P3 on transverse side surfaces, a ground electrode E4 on longitudinal side surfaces. A black circle is a mark for identifying which is an upper surface. The fifth laminated bandpass filter shown in FIG. 14 is different from the laminated bandpass filter in the fourth embodiment shown in FIG. 9 in that there is no 5a-th layer having an electrode for the capacitor C27.

Figure 16:
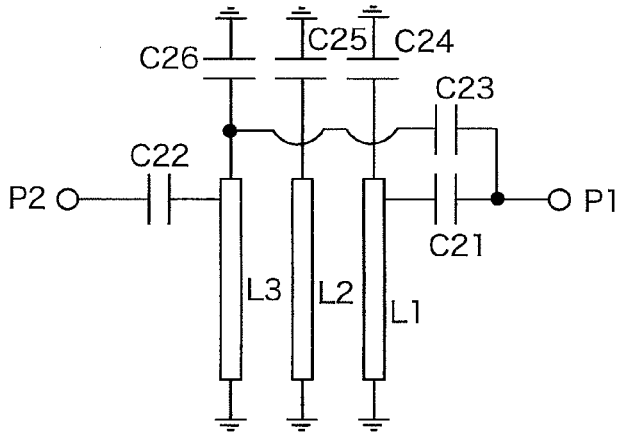
FIG. 16 is a view showing the equivalent circuit of a laminated bandpass filter.

The circuit structure in which the capacitor C23 is connected asymmetrically when viewed from the input or output terminal is applicable to bandpass filters comprising three resonator electrodes L1-L3 all oriented in the same direction as shown in FIG. 16, and bandpass filters in which only the direction of a center resonator electrode L2 is different from those of other resonator electrodes. In the circuit structure shown in FIG. 16, one-side end of the third resonator electrode L3 is connected to the output terminal P2 via the second capacitor C22 and to the input terminal P1 via the third capacitor C23, and grounded via the sixth capacitor C26. The other-side end of the third resonator electrode L3 is grounded. The capacitor C23 is arranged between a connecting point of the input terminal P1 and the capacitor C21, and a connecting point of the resonator electrode L3 and the capacitor C26.

The comparison in attenuation characteristics between the laminated bandpass filter of Example 5 (FIG. 13) and that of Example 4 (FIG. 11) clearly indicates that the addition of the capacitor C27 and the adjustment of the capacitors C23 and C27 make it possible to provide attenuation poles not only in a 2.2-GHz band but also in a 1.3-GHz band while keeping insertion loss in a 2.45-GHz band, thereby securing attenuation on the low-frequency side.

Although the three-stage, laminated bandpass filter has been explained above, the present invention is of course applicable to 4-stage-or-more laminated bandpass filters.

The laminated bandpass filter of the present invention can be produced by printing dielectric ceramic green sheets with a conductive paste of low-resistivity Ag, Cu, etc. to form electrode patterns and filling via-holes with the conductive paste, laminating them, and integrally sintering the resultant laminate. The dielectric ceramic green sheets are preferably sheets of about 10-200 μm in thickness made of dielectric ceramics sinterable at as low temperatures as 1000° C. or lower (LTCC). The dielectric ceramics preferably have, for instance, (a) a composition comprising Al, Si and Sr as main components, and Ti, Bi, Cu, Mn, Na, K, etc. as sub-components, (b) a composition comprising Al, Si and Sr as main components, and Ca, Pb, Na, K, etc. as sub-components, (c) a composition comprising Al, Mg, Si and Gd, or (d) a composition comprising Al, Si, Zr and Mg. The dielectric ceramics preferably have dielectric constants of about 5-15. By an HTCC (high-temperature-co-fired ceramics) technology, patterns of high-temperature-sinterable metals such as tungsten, molybdenum, etc. can be formed on substrates made of alumina-based, dielectric ceramics, and integrally sintered. The substrate materials may be, in addition to the dielectric ceramics, resins or composite materials of resins and dielectric ceramic powder.

[2] High-Frequency Device

The laminated bandpass filter of the present invention can constitute together with other high-frequency circuits a high-frequency component, such as a high-frequency switch module comprising switch circuits for switching the transmission and reception of cell phones or wireless LAN, a composite module integrally comprising a high-frequency switch module and an amplifier circuit, etc. Except for comprising the laminated bandpass filter of the present invention, the high-frequency switch module, etc. may have well-known structures. The high-frequency component has, for instance, a structure comprising a laminate of pluralities of dielectric layers provided with electrode patterns and devices mounted on a laminate surface, the laminated bandpass filter of the present invention being integrally formed in the laminate. Using the laminated bandpass filter in the fourth or fifth embodiment, for instance, a volume occupied thereby can be made 1.5 $mm^3$ or less, so that the entire volume of the high-frequency component can be 150 $mm^3$ or less, particularly 30 $mm^3$ or less.

Figure 17:
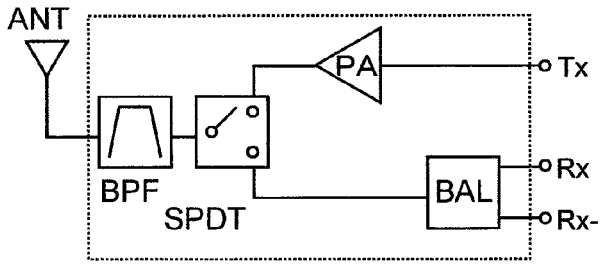
FIG. 17 is a block diagram showing one example of the high-frequency components of the present invention.

FIG. 17 shows a high-frequency switch module, as one example of high-frequency components comprising the laminated bandpass filter of the present invention. This high-frequency switch module comprises an antenna terminal connected to an antenna ANT, a high-frequency switch circuit SPDT for switching a transmission circuit T and a receiving circuit R, a laminated bandpass filter BPF connected between the antenna terminal and the high-frequency switch circuit SPDT, a balanced to unbalanced circuit BAL connected between the receiving circuit R and the high-frequency switch circuit SPDT, and a high-frequency power amplifier circuit PA connected between the transmission circuit T and the high-frequency switch circuit SPDT.

Figure 18:
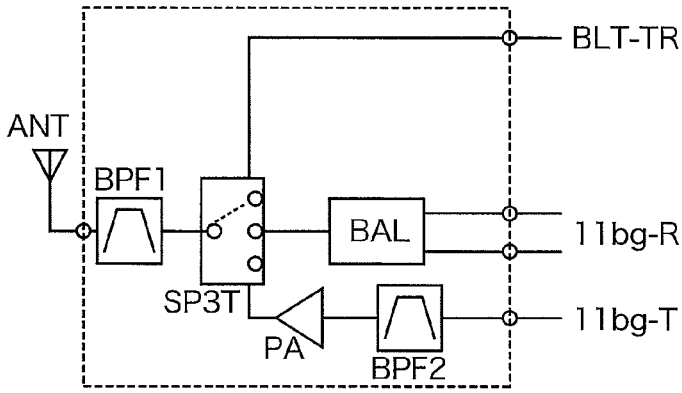
FIG. 18 is a block diagram showing another example of the high-frequency components of the present invention.
Figure 19:
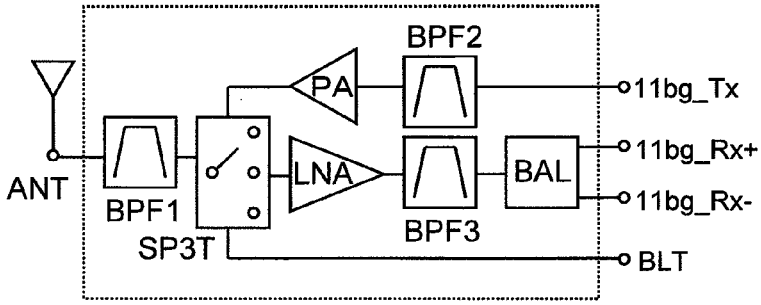
FIG. 19 is a block diagram showing a further example of the high-frequency components of the present invention.

FIG. 18 shows a high-frequency switch module, as another example of high-frequency components comprising the laminated bandpass filter of the present invention. This high-frequency switch module comprises an antenna terminal connected to an antenna ANT capable of connecting transmission and reception with wireless LAN and Bluetooth, a high-frequency switch circuit SP3T for switching the connection of the antenna terminal to a transmission circuit 11*bg*-T of wireless LAN, a receiving circuit 11*bg*-R of wireless LAN and a transmitting/receiving circuit BLT-TR of Bluetooth, a first bandpass filter BPF1 connected between the antenna terminal and the high-frequency switch circuit SP3T, a balanced to unbalanced circuit BAL connected between the receiving circuit 11*bg*-R of wireless LAN and the high-frequency switch circuit SP3T, a high-frequency power amplifier circuit PA connected between the transmission circuit 11*bg*-T of wireless LAN and the high-frequency switch circuit SP3T, and a second bandpass filter BPF2 connected between the transmission circuit 11*bg*-T of wireless LAN and the high-frequency power amplifier circuit PA. As shown in FIG. 19, a low-noise amplifier circuit LNA and a third bandpass filter BPF3 may be disposed in this order between the high-frequency switch circuit SP3T and the balanced to unbalanced circuit BAL in the high-frequency switch module shown in FIG. 18.

Figure 20:
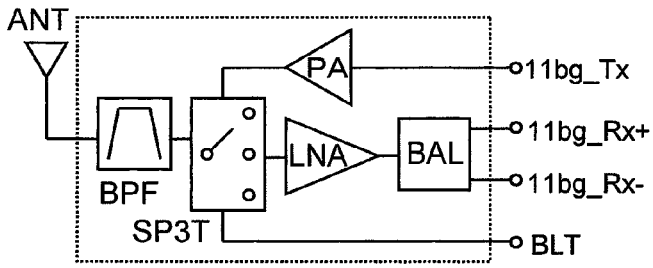
FIG. 20 is a block diagram showing a still further example of the high-frequency components of the present invention.

FIG. 20 shows a high-frequency switch module, as a further example of high-frequency components comprising the laminated bandpass filter of the present invention. This high-frequency switch module comprises a high-frequency switch circuit SP3T for switching the connection of an antenna terminal to a transmission circuit 11*bg*-Tx of wireless LAN, a receiving circuit 11*bg*-Rx of wireless LAN and a transmission/receiving circuit BLT of Bluetooth, a bandpass filter BPF connected between the antenna terminal and the high-frequency switch circuit SP3T, a high-frequency amplifier circuit PA connected between the transmission circuit 11*bg*-Tx and the high-frequency switch circuit SP3T, and a low-noise amplifier LNA and a balanced-to-unbalanced converting circuit BAL arranged in this order between the high-frequency switch circuit SP3T and the receiving circuit 11*bg*-Rx.

Because these high-frequency modules comprise the bandpass filter having small insertion loss and large attenuation, they have high performance with little power consumption. Not restricted to the above circuit structures, the high-frequency module may comprise a diplexer for branching signals in different frequency bands, a low-noise amplifier for amplifying received signals, various filters such as a lowpass filter, a highpass filter, etc., if necessary.

It is preferable that LC circuits, etc. constituting the diplexer, the filter, etc. are formed in the laminate, while inductance elements, capacitance elements, resistance elements, semiconductor elements, etc. are mounted as chip parts on the laminate. The bandpass filters BPF1, BPF2 preferably have attenuation poles in a 2.17-GHz band. The above high-frequency switch module is used in portable communications apparatuses to prevent interference with signals in a WCDMA band (1920-2170 MHz).

Figure 21:
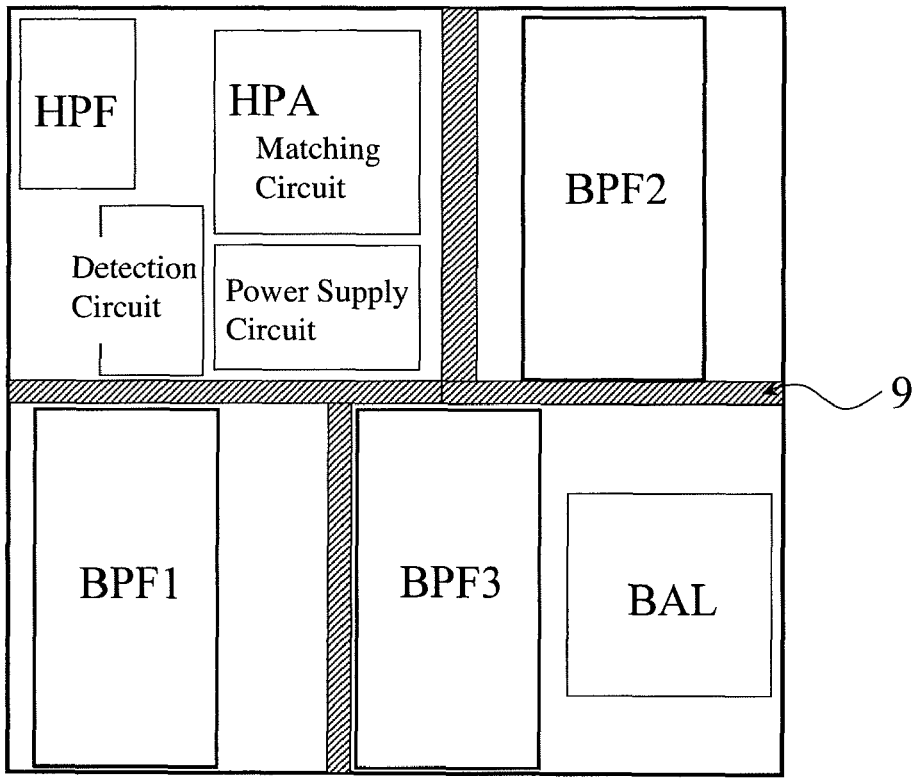
FIG. 21 is a view showing the planar arrangement of a circuit in a laminate constituting the high-frequency component of the present invention.
Figure 22:
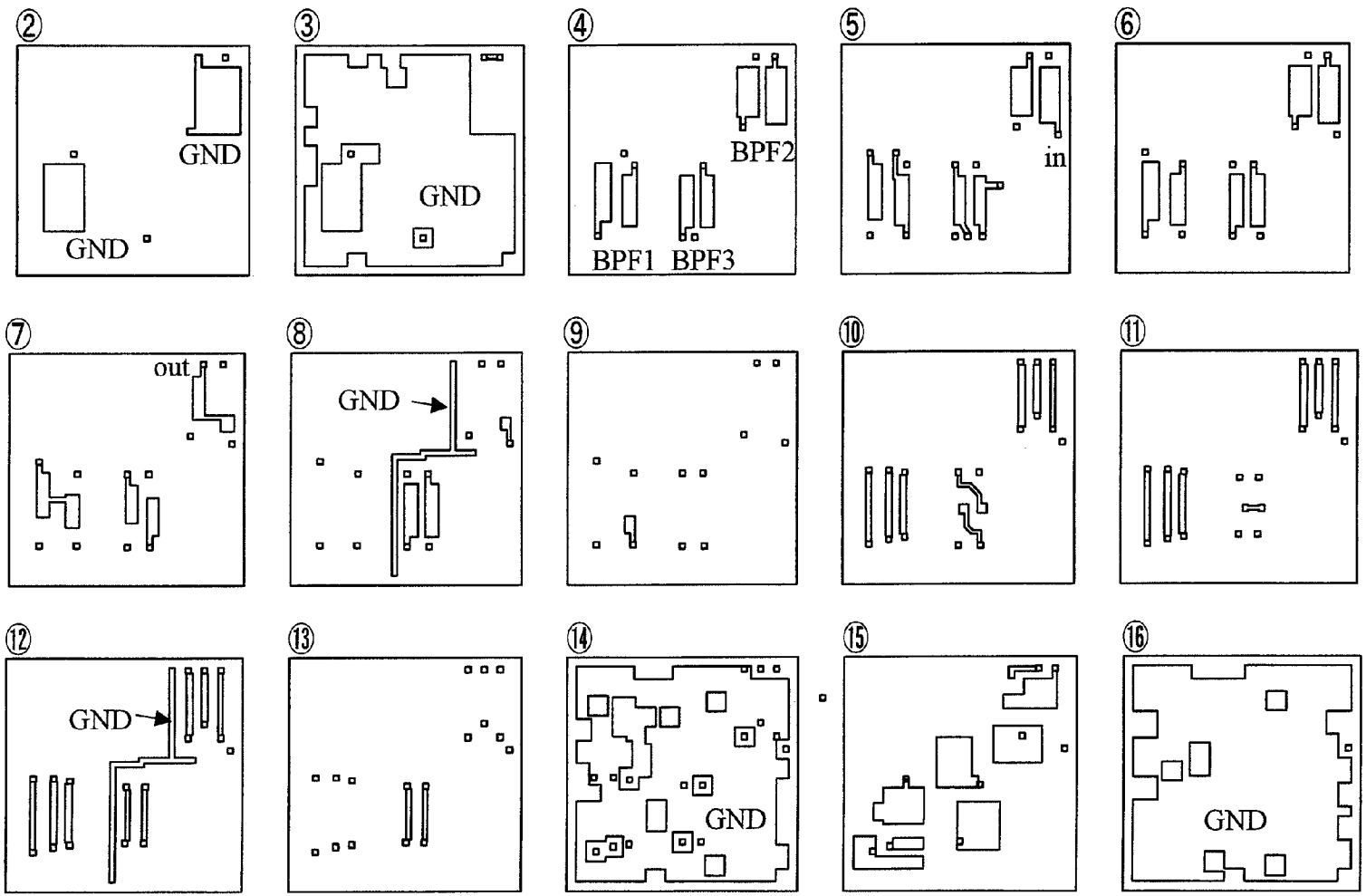
FIG. 22 is an exploded view showing one example of electrode patterns on layers constituting the high-frequency component of the present invention.
Figure 23:
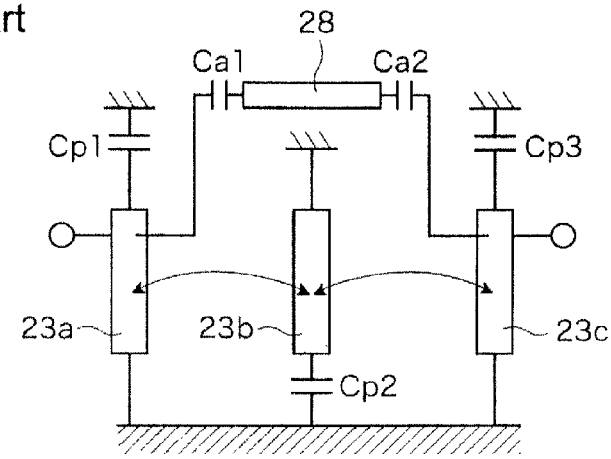
Fig. 23 Related Art
FIG. 23 is a view showing the equivalent circuit of a conventional laminated bandpass filter.
Figure 24:
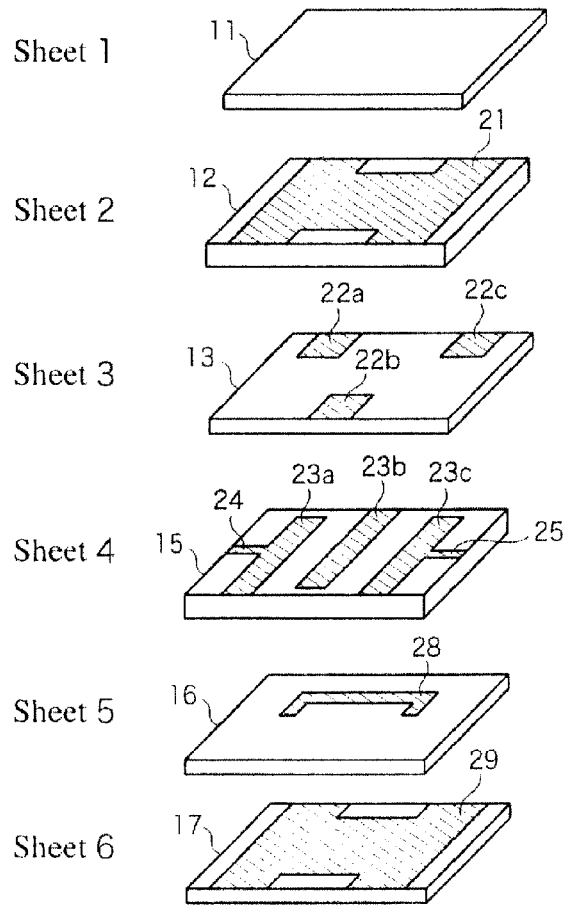
Fig. 24 Related Art
FIG. 24 is an exploded perspective view showing electrode patterns on layers in the conventional laminated bandpass filter.

FIGS. 21 and 22 show one example of high-frequency components comprising the bandpass filter schematically shown in FIG. 19. This high-frequency component comprises a laminate of 17 dielectric layers provided with electrode patterns. Although the high-frequency component comprises other circuit components than those shown in FIG. 19, they are omitted for simplification. Each of a bandpass filter BPF1 connected between the antenna terminal ANT and the high-frequency switch SP3T, and a bandpass filter BPF2 connected between the high-frequency power amplifier circuit PA and the transmission terminal 1lbg-Tx is the laminated bandpass filter of the present invention having a three-stage resonator, and a laminated bandpass filter BPF3 is a bandpass filter having a two-stage resonator. The bandpass filters BPF1, BPF2 having the structure shown in FIG. 8 are arranged at diagonal positions on a main surface of a rectangular laminate. To keep isolation, circuits are partitioned by shield vias or electrodes connected to a ground electrode. There are no shield vias, etc. between the bandpass filter BPF3 and the balanced to unbalanced circuit BAL.

FIG. 22 shows electrode patterns for the bandpass filter on the second to sixteenth layers in the laminate. Each resonator electrode is formed by parallel-connecting three lines on the tenth to twelfth layers. Three resonator electrodes are arranged in parallel. Electrodes for the grounded capacitors C24, C26 are formed on the fourth and sixth layers, and electrodes for the capacitors C21, C22 connected to the input and output terminals are formed on the fifth layer. Electrodes for the coupling capacitor C23 and the capacitor C21 are formed on the seventh layer. Electrodes for the coupling capacitor C27 are formed on the eighth or ninth layer. Formed on the 15th layer are electrodes for the grounded capacitors C24-C26 sandwiched by the ground electrodes on the 14th and 16th layers. With this structure, sufficient grounded capacitors with small electrode areas can be obtained. A ground electrode is formed on the entire third layer, except for a portion facing the grounded capacitor electrode on the fourth layer. Because the grounded capacitor electrode on the fourth layer is opposing the ground electrode on the third layer, the resonator electrodes are distant from the ground, resulting in reduced coupling therebetween, and thus a high-performance, laminated bandpass filter.

[3] Communications Apparatus

The high-frequency component of the present invention can be used for various communications apparatuses, such as cell phones, Bluetooth (registered trademark) communications apparatuses, wireless LAN communications apparatuses (802.11a/b/g/n), WIMAX (802.16e) communications apparatuses, IEEE 802.20 (I-burst) communications apparatuses, etc. Provided are, for instance, small multiband communications apparatuses comprising high-frequency front-end modules capable of using two communications systems of wireless LAN (IEEE802.11b and/or IEEE802.11g) in a 2.4-GHz band and wireless LAN (IEEE802.11a) in a 5-GHz band, or high-frequency front-end modules usable for the standard of IEEE802.11n. The communications systems are not restricted to the above frequency bands and communications standard, and three or more communications systems can be used. The multiband communications apparatuses include wireless communications apparatuses such as cell phones, personal computers (PCs), PC peripherals such as printers, hard disk drives and broadband rooters, home electronic apparatuses such as FAXs, refrigerators, standard televisions, high-definition televisions, digital cameras and digital video cameras, etc.

Effect of the Invention

The three-stage, laminated bandpass filter of the present invention comprising two adjacent resonator electrodes arranged in the same direction and a remaining resonator electrode arranged in an opposite direction are much better in attenuation characteristics on the lower- and higher-frequency sides of a passband than laminated bandpass filters comprising resonator electrodes all arranged in the same direction, and those comprising a center resonator electrode arranged in an opposite direction to resonator electrodes on both sides. Using such laminated bandpass filter, high-performance high-frequency components and communications apparatuses can be obtained.

What is claimed is:

1. A three-stage-resonator, laminated bandpass filter comprising:

first, second, and third resonator electrodes arranged such that adjacent resonator electrodes are electromagnetically coupled and each having a first side end and a second side end opposing the first side end, an input terminal connected to the first resonator electrode, and an output terminal connected to the third resonator electrode, each of the adjacent first and second resonator electrodes having the first side end connected to a first grounded capacitor and a second grounded capacitor, respectively, and the second side end directly grounded, the third resonator electrode having said first side end directly grounded and said second side end connected to a third grounded capacitor, coupling capacitors being formed between at least two of said first, second, and third resonator electrodes, electrodes of said resonator electrodes and said coupling capacitors being formed in a laminate, and at least one coupling-capacitor electrode of the electrodes of the coupling capacitors overlapping said first, second, and third resonator electrodes via no ground electrode when viewed in a lamination direction.

2. The laminated bandpass filter according to claim 1, wherein at least one of said coupling capacitors is a jump capacitor formed between the first resonator electrode and the third resonator electrode, said jump capacitor comprising:

opposing electrodes each facing each of the first and third resonator electrodes on one of the first side ends and the second side ends, and a connecting electrode connecting said opposing electrodes, and wherein said connecting electrode connects end portions of said opposing electrodes on one of the first side ends or the second side ends.

3. The laminated bandpass filter according to claim 2, wherein both ends of said opposing electrodes are inside both longitudinal ends of each first and third resonator electrode, and a connection of said connecting electrode to said opposing electrodes is inside both ends of at least one of said opposing electrodes.

4. The laminated bandpass filter according to claim 2, wherein said opposing electrodes have width equal to or greater than that of the first or third resonator electrode, and said connecting electrode has width smaller than that of said opposing electrodes.

5. The laminated bandpass filter according to claim 2, wherein remaining coupling capacitors comprise a first interstage capacitor and a second interstage capacitor formed between the second resonator electrode and one of the first or third resonator electrode adjacent thereto, respectively, an electrode for said first interstage capacitor is directly connected to said input terminal, and an electrode for the second interstage capacitor is connected to the output terminal.

6. The laminated bandpass filter according to claim 1, wherein each first, second, and third resonator electrode is formed by parallel-connecting ends of transmission lines formed on a plurality of layers.

7. The laminated bandpass filter according to claim 6, wherein a gap between the transmission lines adjacent the lamination direction is smaller than a gap between the resonator electrodes adjacent in a planar direction.

8. The laminated bandpass filter according to claim 1, wherein a layer having said coupling-capacitor electrode is arranged between a layer having electrodes connected to said input or output terminal and a layer having said resonator electrodes.

9. The laminated bandpass filter according to claim 1, wherein the laminate comprises a plurality of layers comprising:

a first layer having a first ground electrode, a second layer opposing the first layer with said first ground electrode and having an electrode which forms at least one of the first, second, and third grounded capacitor, at least one third layer provided with said first, second, and third resonator electrodes, a fourth layer which precedes a fifth layer having a second ground electrode and comprises an electrode which forms at least one of the coupling capacitors, and the fifth layer provided with the second ground electrode, wherein the first, second, third, fourth, and fifth layers are laminated in this order.

10. The laminated bandpass filter according to claim 1, wherein a gap between said first and second resonator electrodes is different from a gap between said second and third resonator electrodes.

11. The laminated bandpass filter according to claim 1, wherein at least part of an electrode forming at least one of said first, second and third grounded capacitor is sandwiched by ground electrodes in said laminate.

12. The laminated bandpass filter according to claim 1, wherein the coupling capacitors comprise first, second, and fifth capacitors;

the first side end of said first resonator electrode is connected to the first side end of said second resonator electrode via said first capacitor;

the second side end of said second resonator electrode is connected to the second side end of said third resonator electrode via said second capacitor; and the first side end of said first resonator electrode is connected to the first side end of said third resonator electrode via said fifth capacitor.

13. The laminated bandpass filter according to claim 1, wherein the coupling capacitors comprise first, second, and fifth capacitors;

the first side end of said second resonator electrode is connected to said input terminal via said first capacitor;

the second side end of said second resonator electrode is connected to said output terminal via said second capacitor; and the first side end of said first resonator electrode is connected to the first side end of said third resonator electrode via said fifth capacitor.

14. The laminated bandpass filter according to claim 1, which comprises first, second, and third capacitors, said first resonator electrode having the first side end connected to said input terminal via said first capacitor;

said third resonator electrode having the second side end connected to said output terminal via said second capacitor; and the second side end of said third resonator electrode being connected to said input terminal via the third capacitor.

15. The laminated bandpass filter according to claim 14, further comprising a fourth capacitor which connects said input terminal and said output terminal.

16. The laminated bandpass filter according to claim 14, wherein at least part of electrodes forming at least one of said first, second, and third grounded capacitors is sandwiched by ground electrodes.

17. A high-frequency component comprising a laminate of pluralities of dielectric layers provided with electrode patterns and devices mounted on a surface of said laminate to constitute a high-frequency circuit used in communications apparatuses, said high-frequency circuit comprising the laminated bandpass filter recited in claim 1.

18. A communications apparatus comprising the high-frequency component recited in claim 17.

19. The laminated bandpass filter according to claim 1, wherein the laminate comprises a plurality of layers and the at least one coupling-capacitor electrode is disposed on one layer and the first, second, and third resonator electrodes are disposed on adjacent another layer with no other layer disposed therebetween, and the at least one coupling-capacitor electrode overlaps the first, second, and third resonator electrodes without an electrical connection with any other electrode.

* * * * *